US008845215B2

(12) United States Patent
Terry et al.

(10) Patent No.: US 8,845,215 B2
(45) Date of Patent: Sep. 30, 2014

(54) LABEL PRINTING APPARATUS

(71) Applicants: Chad Terry, Lunenburg, MA (US); Jonathan Towle, Amherst, NH (US); John Aho, Lunenburg, MA (US); Leslie Scenna, Amherst, NH (US); Thomas Eagan, Chelmsford, MA (US)

(72) Inventors: Chad Terry, Lunenburg, MA (US); Jonathan Towle, Amherst, NH (US); John Aho, Lunenburg, MA (US); Leslie Scenna, Amherst, NH (US); Thomas Eagan, Chelmsford, MA (US)

(73) Assignee: Sanford, L.P., Downers Grove, IL (US)

( * ) Notice: Subject to any disclaimer, the term of this patent is extended or adjusted under 35 U.S.C. 154(b) by 0 days.

(21) Appl. No.: 13/874,007

(22) Filed: Apr. 30, 2013

(65) Prior Publication Data

US 2013/0236229 A1 Sep. 12, 2013

Related U.S. Application Data

(62) Division of application No. 11/952,684, filed on Dec. 7, 2007, now Pat. No. 8,465,220.

(51) Int. Cl.
*B41J 15/04* (2006.01)
*B65C 9/18* (2006.01)

(52) U.S. Cl.
CPC ..... *B41J 15/044* (2013.01); *B65C 2210/0081* (2013.01); *B65C 9/1892* (2013.01)
USPC ..... 400/613; 242/590; 242/611

(58) Field of Classification Search
USPC ..... 400/613, 242
See application file for complete search history.

(56) References Cited

U.S. PATENT DOCUMENTS

| | | | | | |
|---|---|---|---|---|---|
| 3,312,410 | A * | 4/1967 | Strothmann | 242/611.2 |
| 3,347,485 | A * | 10/1967 | Bundschuh | 242/597.6 |
| 3,417,939 | A * | 12/1968 | Bunting | 242/597.5 |
| 4,436,573 | A * | 3/1984 | Sato et al. | 156/384 |
| 4,505,773 | A | 3/1985 | Sato et al. | |
| 4,557,617 | A * | 12/1985 | Richardson et al. | 400/208 |
| 4,823,953 | A | 4/1989 | Anderson et al. | |
| 5,439,303 | A * | 8/1995 | Alday | 400/242 |
| 6,923,582 | B2 * | 8/2005 | Pomfret | 400/242 |
| 2007/0009302 | A1 | 1/2007 | Vandermeulen | |

FOREIGN PATENT DOCUMENTS

| | | |
|---|---|---|
| JP | 549933 | 1/1979 |
| JP | 2006512223 A | 4/2006 |
| WO | WO-2004/059241 A2 | 7/2004 |

OTHER PUBLICATIONS

International Search Report and Written Opinion for Application No. PCT/EP2008/066923, dated Mar. 4, 2009.
Office Action (Notice of Reason for Rejection) for Japanese Patent Application No. 2010-536480, dated Mar. 28, 2013.
Extended European Search Report for EP Application No. 13187177.4, dated Apr. 22, 2014.

* cited by examiner

*Primary Examiner* — Jill Culler
(74) *Attorney, Agent, or Firm* — Marshall, Gerstein & Borun LLP

(57) ABSTRACT

A cassette is provided which includes a supply of label material and a brake. The brake has a first position and a second position. In the first position, the supply is clamped by the brake. In the second position, the supply is removable from the cassette.

16 Claims, 20 Drawing Sheets

LABEL PRINTING APPARATUS

FIELD OF INVENTION

The present invention relates to a cassette and a label printing apparatus.

TECHNOLOGICAL BACKGROUND

Label printing apparatus which print on label material such as discrete or die cut labels or on a continuous supply of tape are known. The known label printing apparatus is arranged to receive various different widths of label material.

Label printing apparatuses which use label material in the form of rolls are known. These rolls are of varying width and diameter. The label material is wound on a core. The rolls of label material are manually loaded onto a spool and placed in the printer. The labels are manually fed into the print location. Thus loading and unloading of the label material into and out of the label printing apparatus requires the user to manually interact with the label printing apparatus and perform several steps manually to ensure that the label material is correctly oriented in the label printing apparatus.

Label printing apparatuses with a supply of label material provided on a disposable roll holder are also known. The roll holder, with the supply of label material is manually guided to a specific location in the label printing apparatus to ensure that the label material is properly positioned. The label material is manually fed into or placed through the printing region.

There have been proposed various mechanism for identifying the type of label material in the label printing apparatus ranging from manually inputting this information to various automatic detection schemes.

There is a problem with the current label printing apparatus in that it is time consuming, difficult and frustrating for a user to change the label material and ensure that a new supply of label material is correctly positioned. This is a particular problem if the supply of label material needs to be changed frequently. The supply of label material may be changed if it has run out or a user wants to print on a different type of label material. However, the inventors have realized that this is not straight forward.

Dealing with the label material in the cassette is a problem. For example, for effective printing, the inventors have realized that the label material should not be compromised when the cassette is handled by the user.

It is an aim of some embodiments of the invention to address one or more of the problems mentioned previously.

SUMMARY OF INVENTION

A first aspect of the present invention may provide a cassette comprising a supply of label material; and a brake, said brake having a first position and a second position, wherein in said first position, said supply is clamped by said brake and in said second position, said supply is removable from said cassette.

A second aspect of the present invention may provide a label printing apparatus comprising: a cassette receiving bay; and a cassette located in said cassette receiving bay, the cassette comprising: a supply of label material; and a brake, said brake having a first position and a second position, wherein in said first position, said supply is clamped by said brake and in said second position, said supply is removable from said cassette.

A third aspect of the present invention may provide a label printing apparatus comprising: a cassette receiving bay; and a brake activation mechanism, said brake activation mechanism arranged to interact with a brake of a cassette, when inserted in said cassette receiving bay, said brake activation mechanism causing said brake to move from a first position to a second position.

A fourth aspect of the present invention may provide a cassette comprising a supply of label material; and brake means, said brake means having a first position and a second position, wherein in said first position, said supply is clamped by said brake means and in said second position, said supply is removable from said cassette.

A fifth aspect of the present invention may provide a label printing apparatus comprising: cassette receiving means; and a cassette located at said cassette receiving means, the cassette comprising: a supply of label material; and brake means, said brake means having a first position and a second position, wherein in said first position, said supply is clamped by said brake means and in said second position, said supply is removable from said cassette.

A sixth aspect of the present invention may provide a label printing apparatus comprising: cassette receiving means; and brake activation means, said brake activation means arranged to interact with brake means of a cassette, when received at said cassette receiving means, said brake activation means causing said brake means to move from a first position to a second position.

A seventh aspect of the present invention may provide a cassette comprising: a support post; a supply of label material having a central opening;

and an insert arranged over said support post and in said central opening, said insert and said support post being arranged to resist relative rotation of said insert and said support post unless at least a predetermined force is applied.

An eight aspect of the present invention may provide a cassette comprising: support means; a supply of label material having a central opening;

and insert means arranged over said support means and in said central opening, said insert mean and said support means being arranged to resist relative rotation of said insert means and said support means unless at least a predetermined force is applied.

BRIEF DESCRIPTION OF THE DRAWINGS

For a better understanding of the present invention and how to how the same may carried into effect, reference will now be made by way of example only to the accompanying drawings in which.

Figure 2A:
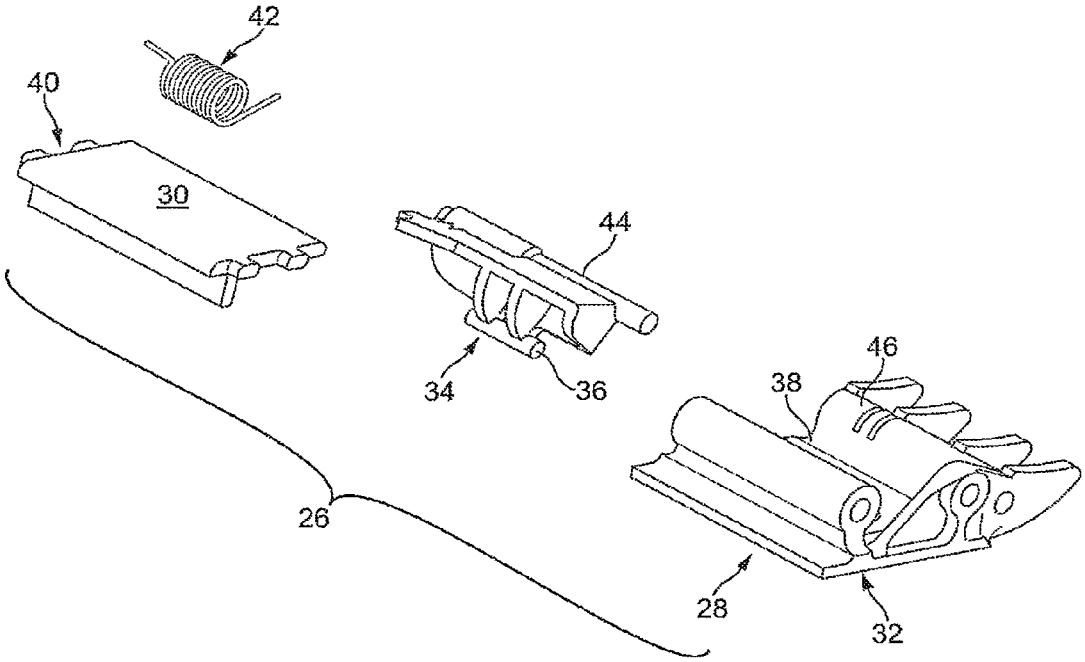
FIG. 2A shows the elements forming a media brake in the cassette of FIG. 1.
Figure 2B:
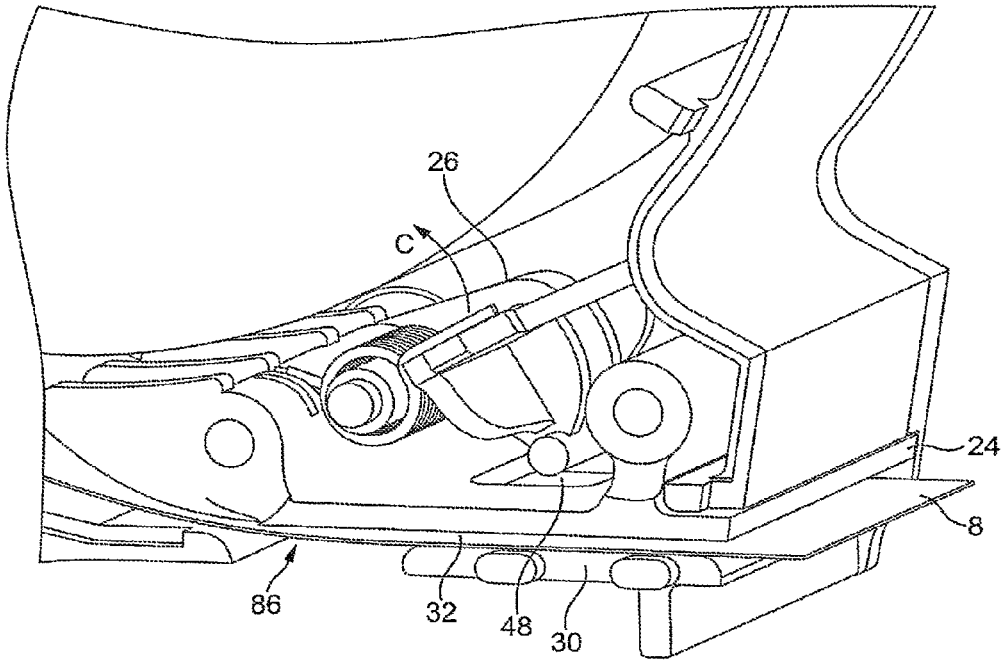
FIG. 2B shows a view of a corner of the cassette, similar to the view of FIG. 1B but with the cassette housing removed.
Figure 3:
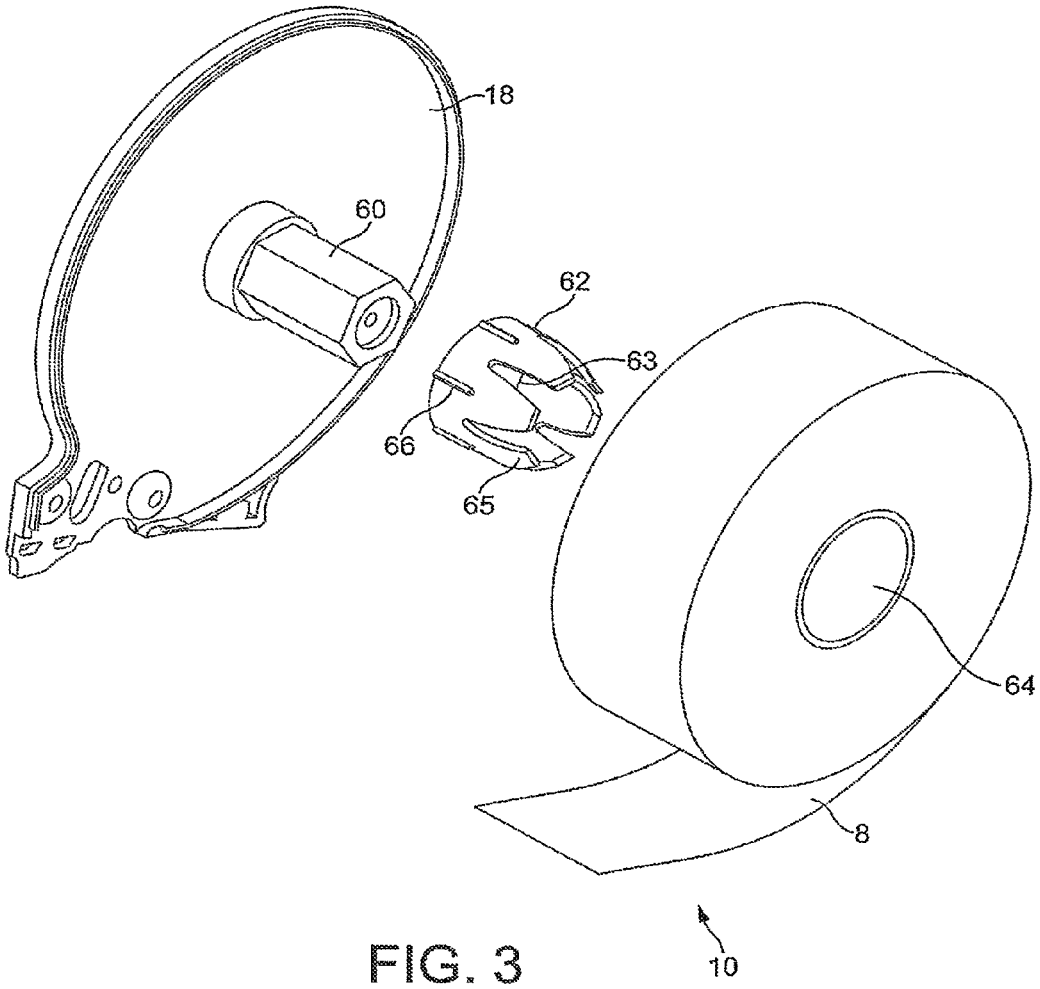
FIG. 3 shows an expanded view of a label material support mechanism and drag brake mechanism.

Reference is now made to FIGS. 1 to 3 which show cassettes 10 embodying the present invention. In each of FIGS. 1*a*, 1*b*, 1*c* and 1*d*, a cassette 10 is arranged to house a roll 8 of label material. It should be appreciated that the label material can take any suitable form. For example, the roll 8 may comprise a roll of discrete or die cut labels provided on a backing layer. Alternatively, the roll can comprise a continuous length of material (e.g. tape) which may be cut to a desired size. The continuous material may have an adhesive layer. In this case, a backing layer may be provided. In yet another alternative, the label material may comprise individual label regions separated by areas of weakness, such as perforations or the like.

The material of the labels can be any suitable form, for example paper, polypropylene or any other material.

Figure 1A:
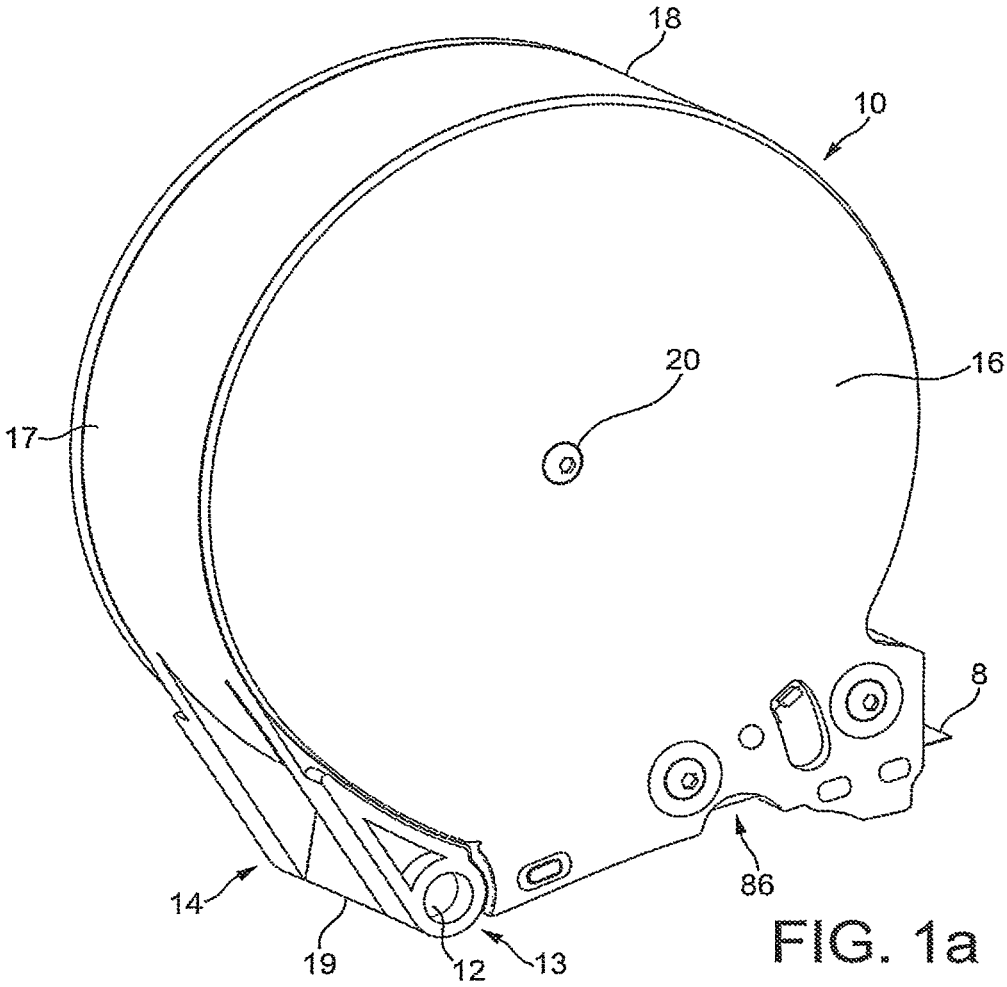
FIG. 1A shows a perspective view of a cassette embodying the present invention.
Figure 1B:
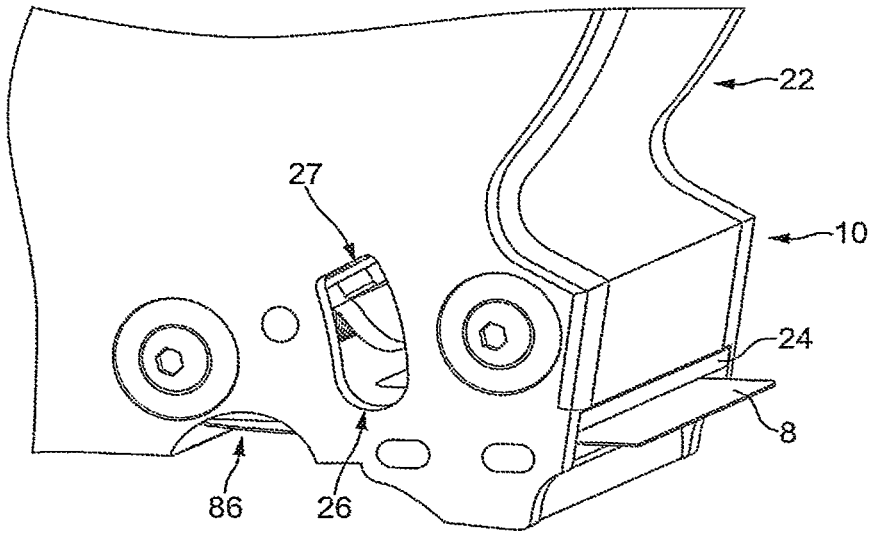
FIG. 1B shows an enlarged view of a corner region of the cassette.
Figure 1C:
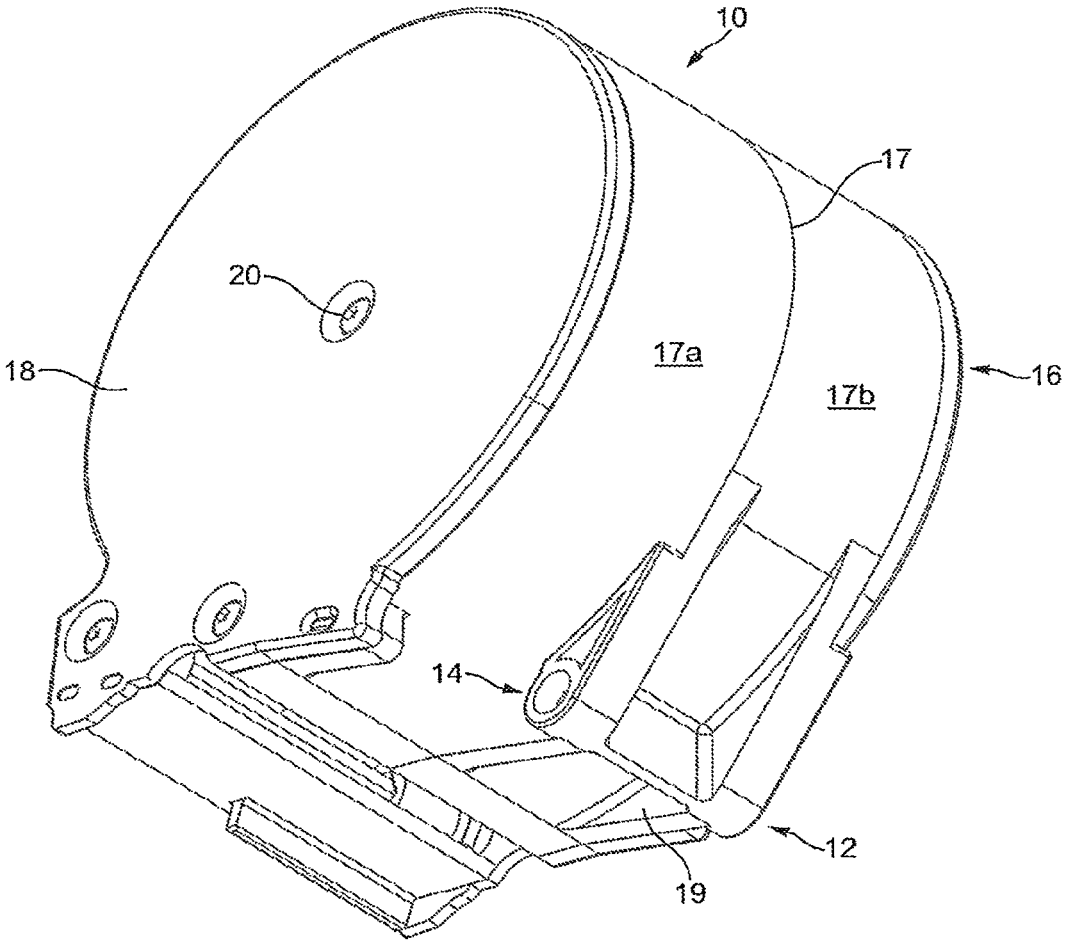
FIG. 1C shows a perspective view of another cassette embodying the present invention.
Figure 1D:
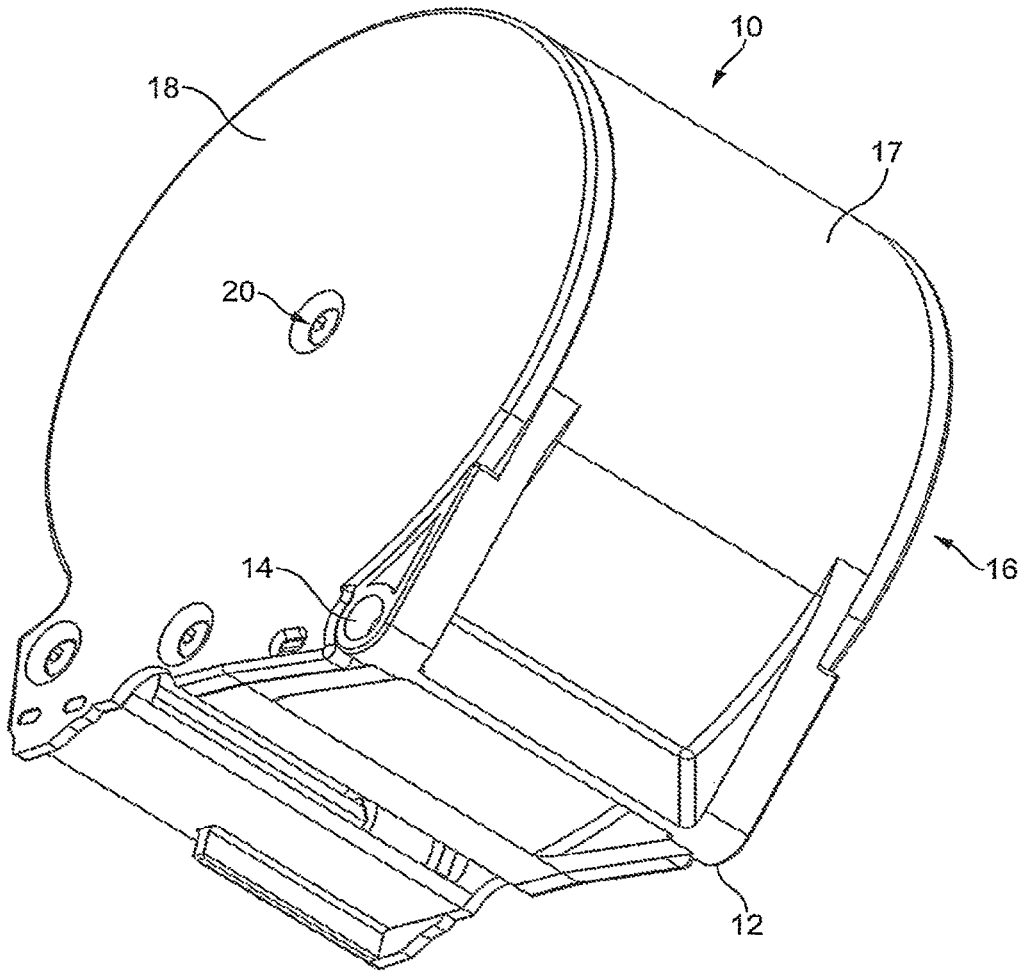
FIG. 1D shows a perspective view of a further cassette embodying the present invention.

The cassette is arranged to have a first connection portion 12, as shown in FIGS. 1*a*, 1*c* and 1*d*. A similar, second, connection portion 14 is provided on the opposite side of the cassette 10, directly opposite to the connection portion 12. In the embodiments shown in the drawings, the connection portions 12 and 14 are indented, and are generally cup like in shape, having a circular cross section. In other embodiments, the connection portions 12, 14 may not be indented. In certain embodiments, the indented portions are closed at an end. The indented portions 12 and 14 receive respective locking members from the label printing apparatus, as will be described in more detail hereinafter.

In FIG. 1*a*, the cassette 10 has two respective planar sides 16, 18 between which is provided a middle portion 17 formed from a single middle section. The connection portions 12, 14 are formed at respective sides of a grip region 19 of the middle section. The grip region 19 extends fully between the two sides 16, 18. The cassette 10 has a width between the sides 16, 18, and is capable of housing a roll of label material 8 of up to this width.

In FIG. 1*c*, an alternative arrangement is shown. Here, the cassette 10 again has the two respective planar sides 16, 18, but the middle portion 17 comprises first and second sections 17*a*, 17*b*. Connection portions 12, 14 similar to those in FIG. 1*a* are again formed at respective sides of a grip region 19, but this grip region 19 is only formed on a second section 17*b* of the two middle sections of the middle portion 17. Thus, the grip region 19 only extends partially between the sides 16, 18 of the cassette 10. The grip region 19 thus extends fully across the width of one of the first and second sections 17*a*, 17*b* of the middle portion 17 but only partially across the width of the middle portion 17. Thus, the grip region 19 is of the same width for the two cassettes 10 of different widths shown in FIGS. 1*a* and 1*c*.

The cassette 10 of the present invention can be of a modular construction. Respective sides 16, 18 can be used in each variant of the cassette 10, but one, two, three or more (i.e. a plurality) of middle sections can be provided to form the middle portion 17 between the two sides 16, 18. Such middle sections can be thought of as "stacking" together to form a complete middle portion 17 of the cassette 10. Such a modular construction allows different widths (in an axial direction) of rolls of label material 8 to be housed in the cassette 10 of the present invention.

In FIG. 1*c*, the second section 17*b* is identical to the single middle section shown in FIG. 1*a*, though it need not be in all embodiments of the present invention. In FIG. 1*c*, the cassette 10 is arranged to house a roll of label material 8 which is of greater width than the roll containable by the cassette 10 shown in FIG. 1*a*.

In FIG. 1*d*, a cassette 10 is illustrated which is of a greater width between the sides 16, 18 to the cassette 10 shown in FIG. 1*a*. The cassette 10 in FIG. 1*d* is of the same width as the cassette 10 shown in FIG. 1*c*, and can thus house a roll of label material 8 which is of the same width as the roll containable by the cassette 10 shown in FIG. 1*c*. The cassette 10 in FIG. 1*d* again has the two respective planar sides 16, 18, but the middle portion 17 is formed from a single middle section, rather than first and second sections 17*a*, 17*b*, as is the case in FIG. 1*c*. The grip region 19 extends fully across the middle portion 17. Therefore, the grip region 19 extends across the full width of the cassettes 10 of different widths shown in FIGS. 1*a* and 1*d*.

In other embodiments of the present invention, one or both of the connection portions 12, 14 may be part of a respective side part 16, 18 of the cassette 10. In other embodiments, one or both of the connection portions 12, 14 may be part of the middle portion 17 of the cassette 10. In preferred embodiments of the present invention, the connection portions 12, 14 comprise cup like indented portions. However, other shapes can be provided for these portions.

In one embodiment of the present invention, the indented portions may comprise two holes, which may be interconnected to provide an open ended cylinder.

In other embodiments, one or each of these connection portions 12, 14 may not be indented, or female, portions. Indeed, one or each of connection portions 12, 14 may be male portions (though not shown in the drawings). The male portions may protrude outwards from the cassette 10 beyond respective planar surfaces 16, 18 of the cassette 10. Alternatively, such male portions may only protrude from the cassette 10 to an extent such that the distal end of the male portions are flush or generally flush with a respective planar surface 16 and 18 of the cassette 10. One connection portion may be male and the other female, or they may both be of the same "gender".

The connection portions 12, 14 are adapted to engage first and second engagement members of a label printing apparatus, as described below. Thus, in the drawings, the interface between the connection portions 12, 14 and the respective first and second engagement members is such that each connection portion co-operates with an engagement portion of the label printing apparatus.

In different embodiments, the interface could be a peg of one of the cassette 10 and the label printing apparatus adapted to locate in a socket, or fit in and follow a groove, formed in the other of the cassette 10 and the label printing apparatus. The interface could be an arc-shaped protrusion of one of the cassette 10 and the label printing apparatus which is adapted to fit in and follow a groove in the other of the cassette 10 and the label printing apparatus. Other arrangements are also conceivable.

As will also be discussed below, the cassette 10 shown in the drawings is arranged to rotate about an axis which runs between the connection portions 12, 14, and thus also between the first and second engagement members of the label printing apparatus. Thus, the connection portions 12, 14 in the drawings are permitted to rotate about this axis relative to the first and second engagement members.

In other embodiments, the parts of the connection portions 12, 14 which interface with the engagement members of the label printing apparatus, such as by contacting them, may not move relative to the part of the engagement members that they interface directly with. In such a case, one or other or both of a connection portion 12, 14 and an engagement member may include at least two members, which are permitted to rotate relative to the other. For example, a connection portion may be a cup like indented portion, as shown in the figures. The corresponding engagement member of the label printing apparatus may be a peg adapted to rotate about an axis relative to another element of the label printing apparatus. Thus, when the peg is inserted in the indented portion, the peg does not rotate relative to the indented portion, but the peg rotates about its axis relative to the other element of the label printing apparatus. Since in this arrangement the indented portion would not move relative to another element, this arrangement would reduce wear on indented portion 12, 14 of the cassette 10.

In the embodiment shown in FIGS. 1*a* and 1*d*, the indented portions 12 and 14 are provided so that their respective openings are flush or generally flush with a respective planar surface 16 and 18 of the cassette 10. However in some embodiments of the invention, the respective openings are arranged to be proud, that is extend outwardly, of the respective planar surfaces 16 and 18.

In FIGS. 1*a* and 1*d*, the connection portions 12 and 14 are provided on the respective opposing surfaces 16 and 18 of the cassette. Surfaces 16 and 18 are each perpendicular to the axis of rotation 20 of the roll of labels. In use, as will be described in more detail hereinafter, a first corner region 13 of the cassette on which the connection portions 12 and 14 are provided is generally arranged to be lowermost in the label printing apparatus. In one embodiment of the invention, the surfaces 16 and 18 will be arranged so as to be vertical or generally vertical.

In a second corner region, 22, spaced apart from the first corner region is a media brake 26. The first and second corner regions are generally the lowermost part of the cassette when received in the label printing apparatus, with the roll of label material generally supported above these two corner regions.

The media brake 26 is arranged to clamp the label material 8 when the cassette is being transported or when the cassette is being inserted or being removed from the label printing apparatus. In one embodiment of the invention, the media brake is applied except when the cassette is in the correct position in the label printing apparatus for printing. The cassette comprises a label material outlet 24 in this second corner region 22 of the cassette. The media brake 26 is arranged to clamp the label material adjacent the outlet 24.

The cassette 10 includes a label material guiding member 28 and a wall member 40, between respective opposing surfaces 32, 30 of which the label material is arranged to pass adjacent to the outlet 24. The gap between the surfaces 32, 30 is fixed. It should be appreciated that the wall member 40 may be a separate member, as shown in FIG. 2*a*, or an integral part of the cassette wall.

The media brake 26 also comprises a brake member 34, also referred to as a clamping part. The brake member 34 includes an elastomer pressure pad 36, also termed a pressing member. This elastomer pressure pad 36 is in the form of a cylinder which presses against a surface of the label material through an opening 48 in the guiding member 28. This pressing presses the opposite side of the label material 8 into contact with the wall surface 30 of wall member 40, to clamp the label material between the brake member 34 and the wall member 40. The pressure pad 36 may take on another form and/or manufacturing process. It may be the result of an over-mould or secondary thermoplastic elastomer (TPE) part. The pad 36 may be other shapes other than cylindrical, such as a flat pad, or a cylinder with an elliptical, square or rectangular cross section or a cross section of any other polygon. In other embodiments, the pressure pad 36 may not be made from an elastomer material. The pressure pad 36 may be made from a solid, non-compressible, or substantially non-compressible, material. The pressure pad 36 may be formed from an inelastic or an elastic material, and from a flexible or non-flexible material.

The brake member 34 and/or the pressing member 36 of the brake member 34, in preferred embodiments of the present invention, is arranged to have a dimension such that it extends substantially across the width of the label material 8, and/or substantially across the width of the cassette 10 between its sides 16, 18. In alternative embodiments of the present invention, the brake member 34 and/or the pressing member 36 may have a larger or smaller dimension in the width direction of the cassette 10. Where more than one width of label material 8 can be used with the cassette 10 and label printing apparatus as a whole, the width of the brake member 34 and/or the pressing member 36 may be of a similar dimension to the width of the largest size of label material which can be used with the label printing apparatus.

The media brake also has a brake spring 42. The brake spring 42 is arranged around a cylindrical part 44 of the brake member 34. The spring 42 is arranged to act against the guiding member 28 and in particular is arranged to engage groove 46 of the guiding member 28. In other words, one end of the spring 42 engages the brake member 34 and the other is arranged to engage the guiding member 28. The spring 42 acts to bias the brake member 34 towards the label material 8, and thus the pressure pad 36 into contact with the surface of the label material 8. Rather than a coil spring 42, in other embodiments, any type of biasing arrangement may be provided to perform this role, such as a leaf spring, or an elastic material. This means that when the cassette is being transported, or inserted or removed from the label printing apparatus, the label material 8 is clamped in position relative to the outlet 24. The clamping of the label material 8 prevents the label material 8 from being wound off the label supply. This means that the label material 8 does not come out of the cassette 10 and the tension of the label material 8 on the label supply is maintained.

When the cassette 10 is correctly inserted in the label printing apparatus, as will be described in more detail hereinafter, the media brake 26 is engaged by a brake actuating member 174 of the label printing apparatus which lifts up the brake member 34, with respect to the guiding member 28. In particular, the biasing force of the spring 42 is overcome so that the pressure pad 36 no longer is urged against the label material 8. This releases the pressure on the label material 8 so that the label material 8 is no longer clamped and can be driven out of the cassette 8. The mechanism for actuating the brake member 34 will be described in more detail hereinafter.

Figure 10B:
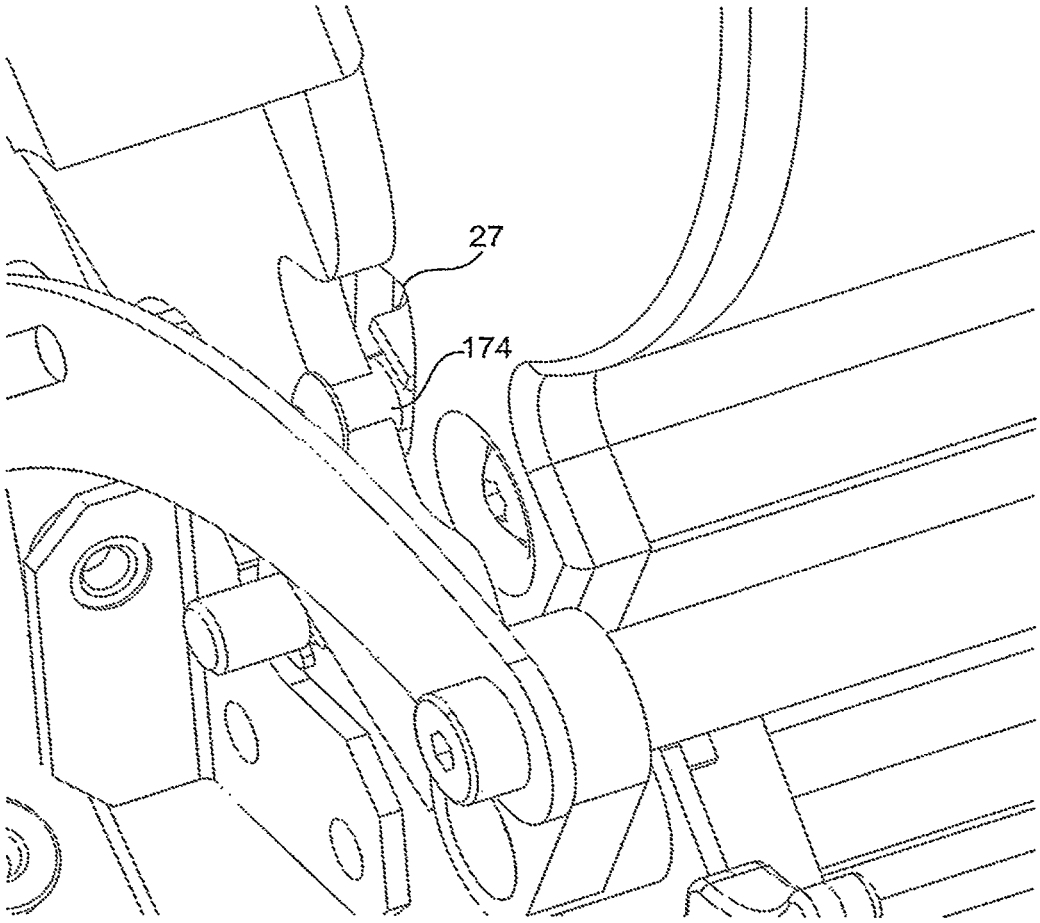
FIG. 10B shows a view similar to FIG. 9B, but with the cassette having the position shown in FIG. 10A.
Figure 11A:
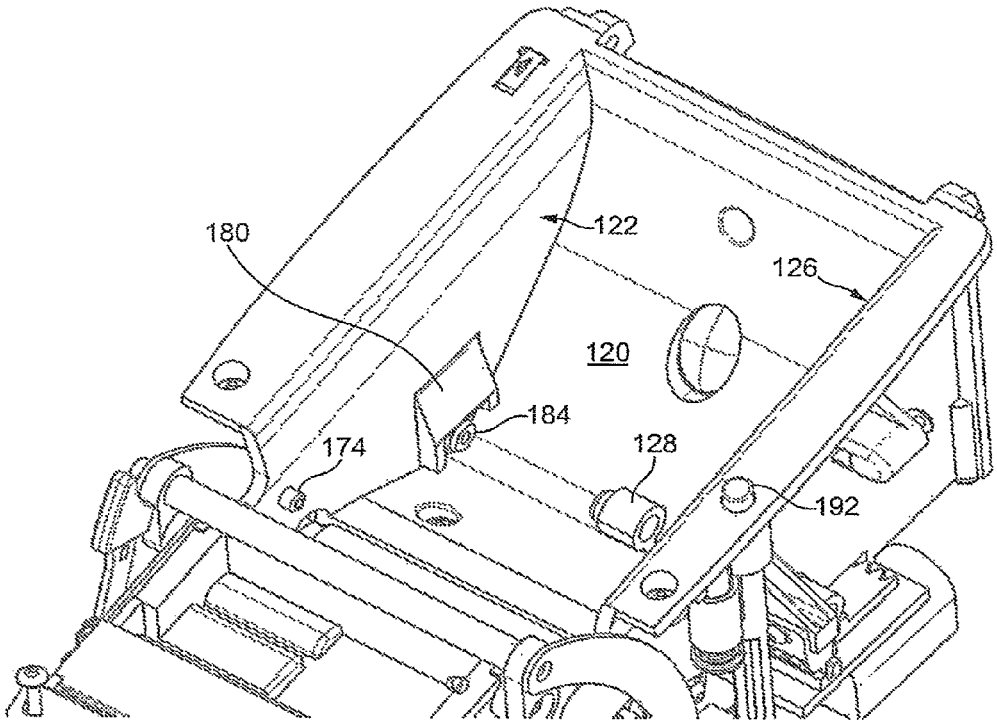
FIG. 11A shows a first view of the cassette receiving bay from a first direction so that a first side wall is visible

The cassette has an opening 27 adjacent the media brake 26, which can be seen in FIG. 1. The opening 27 is provided in side 16 of the cassette 10. In other embodiments, the opening may be provided in side 18 of the cassette 10, or in one of the surfaces of the middle portion 17 of the cassette 10. This opening 27 is aligned with the brake member 34 and allows a brake actuating member 174, or protrusion, of the label printing apparatus, which is fixed in position relative to the cassette receiving bay 120, to be inserted in the opening 27 (see FIGS. 9B, 10B and 11A). When the cassette 10 is received in the cassette receiving bay 120, as will be discussed below, a cassette positioning mechanism moves the cassette 10 into a position at which printing can take place. This is termed the left-justifying mechanism. This movement of the cassette 10 relative to the receiving bay 120, and hence relative to the brake actuating member 174, causes the brake actuating member 174 to enter the opening 27 in the cassette.

Once the cassette is left-justified in the receiving bay 120, then due to the relative dimensions of the cassette 10 and the receiving bay 120, the cassette can be rotated within the bay 120 about an axis defined by first and second engagement members 128, 184, which are engaged with the respective first and second connection portions 12 and 14. Such rotation of the cassette 10 results in relative movement between the cassette 10 and the brake actuating member 174, which is located in the opening 27 and adjacent (under) the brake member 34 of the cassette 10. The brake actuating member 174 thus lifts the brake member 34 relative to the rest of the cassette 10, against the biasing of the spring 42, thus releasing the braking effect on the label material 8.

In some embodiments of the present invention, the rotational movement of the cassette 10 is caused by a pressure bar 80 acting on the cassette 10 to rotate the cassette 10 about the axis defined by the first and second engagement members 128, 184, when the pressure bar 80 is engaged with the cassette 10. This will be discussed in more detail below.

It should be appreciated that the specific example of the clamping mechanism can be changed for any suitable mechanism. For example, the spring can be replaced by any other suitable biasing member. Additionally, in some embodiments of the present invention, fewer or more parts, than that shown in FIG. 2A may be provided. For example, the guiding member 28 and the brake member 34 can be combined so as to be replaced by a single member, in which case the combined single member would be arranged to press against a surface of the label material 8 to clamp the label material 8 in position.

In preferred embodiments of the present invention, the media brake 26 has been shown as clamping the label material 8 near the outlet 24 of the cassette 10. In alternative embodiments of the present invention, the media brake 26 may be provided at any other suitable location. For example, the media brake 26 may, in some embodiments of the present invention be arranged to act against the label material 8 when it is provided on the label supply roll.

Reference is now made to FIG. 3. This shows the interior of the cassette 10. On the interior of surface 18, there is provided a support post 60. The support post 60 is arranged to have a hexagonally shaped circumference. An insert 62 is provided. The insert 62 has a circular internal cross section. The diameter of this internal cross section is at least the same as the diameter of the hexagonally shaped circumference when the latter is measured between two opposing peaks of the hexagonal circumference. Additionally the insert 62 is provided with a number of cut outs 63 extending generally parallel to the longitudinal axis of the insert 62. The cut outs provide prongs 65 extending from the main body of the insert 62. The internal diameter of the insert at the distal end of the prongs 65 is less than the diameter of the hexagonally shaped circumference of the post 60 when the latter is measured between two opposing peaks of the hexagonal circumference. The insert 62 is arranged to be placed over the support post 60.

The insert 62 is arranged to be received in the core (or opening) 64 of the label material 8. The insert 62 has at least one projection 66 extending outwardly therefrom which mates with the core 64 to provide an interference fit between the insert 62 and the core 64. The insert 62 is arranged so that there is no relative movement between the insert 62 and the post 60 if less than a predetermined turning force is applied to one of the insert 62 and the post 60 relative to the other, and furthermore no relative movement between the insert 62 and the core 64 unless a second predetermined force is applied to them, which second predetermined force is greater than the predetermined force required for relative rotation between the insert 62 and the core 64. The insert 62 is thus arranged to rotate relative to the support post 60 when at least the predetermined force is applied.

As the support post 60 is hexagonal and the internal circumference of the insert 62 is circular, relative movement between the support post 60 and the insert 62 is possible. The cut outs are such they provide flexibility to the insert to allow the rotational movement. On applying a sufficient turning force between the post 60 and the insert 62, the distance between the distal ends of the prongs 65 of the insert 62 increases and the prongs 65 climb over the peaks of the hexagonal cross section of the post 60. However, there will be some resistance to the rotational movement caused by the effective interference fit between the prongs 65 and the post 60. This means that label material 8 will not unwind from the core easily. The resistance is such that the resistance can be overcome with a driving force applied to the label material 8 of at least a predetermined magnitude. The driving force may be provided by a feed roller 84 or the like (as will be described in more detail hereinafter). Since the label material 8 does not easily unwind from the core 64 and remains relatively tightly wound on the core 64, back-up space is provided between the label material 8 held on the core 64 and the inner surface and outlet 24 of the cartridge 10. In order to drive the label material 8 back into the cartridge, a force is applied to the label material 8, such as via a feed roller 84, discussed below, and the label material 8 is able to occupy this available back-up space.

It should be appreciated that the insert 62 and the support post 60 can have any suitable shapes. The criterion is that relative rotation between the insert 62 and the support post 60 is possible but only if a driving force is applied, to prevent unravelling. In some embodiments of the present invention, the insert 62 may be omitted and instead the interaction between the core 64 of the label roll and the fixed support post 60 may provide the necessary resistance. In some embodiments of the present invention, the insert 62 may be integrally formed with the core 64 of the supply. In which case, the core 64 and the support post 60 would be arranged to resist relative rotation between themselves, unless the predetermined force is applied.

The hexagonal shape of the support post 60 is by way of example only. Other shapes are possible. For example, the support post can have any suitable number of sides or may even be a circular side, provided that the core 64 or the insert 62 is arranged to have a frictional or resistant engagement therewith.

Alternative frictional or resistance providing arrangements may alternatively or additionally help to achieve the required effect.

In the embodiment described, the insert 62 has cut away portions 63 to provide a degree of flexibility. These cut away portions 63 may be omitted in some embodiments of the invention. Flexibility of the insert 62 may achieved by other methods such a by the use of suitable materials of suitable thicknesses.

Figure 4A:
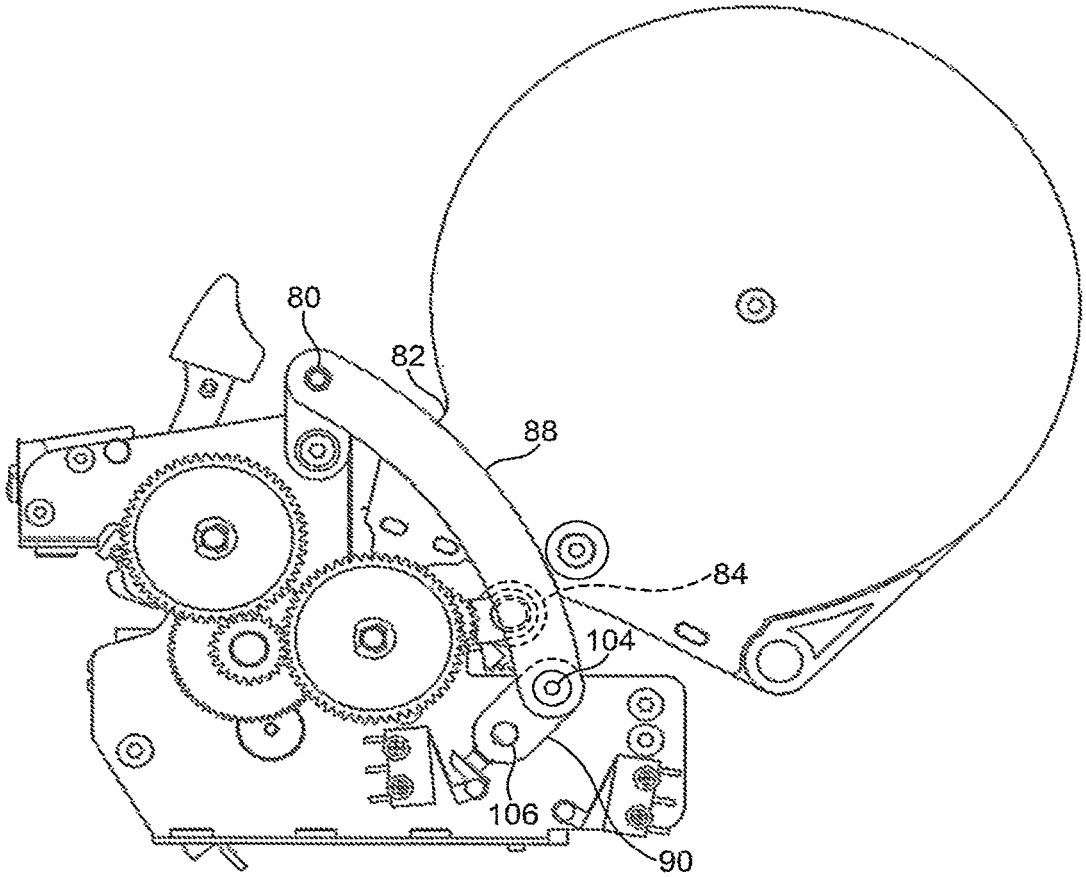
FIG. 4A shows a view of a pressure bar mechanism, in a first position.

Reference is now made to FIGS. 4A to 8 which show a pressure bar 80 for retaining the cassette 10 in position. The pressure bar 80 is arranged to have a first configuration in which it is spaced apart from a cassette 10 and a second configuration in which it engages in a suitable shaped engagement portion 82 of the cassette 10. The first configuration is shown in FIGS. 4A and 4B. The second configuration is shown in FIGS. 5A and 5B. The engagement portion 82 is provided generally above the label outlet 24. The cassette is generally shaped so that when it is in the cassette receiving bay 120 of the label printing apparatus, the first corner 13 of the cassette with the connection portions 12 and 14 are lowermost. Thus, the cassette is able to pivot about the pivot axis defined by the connection portions 12 and 14.

When the pressure bar 80 contacts the cassette 10, rotational movement of the cassette about the axis defined by the portions 12 and 14 is permitted. The pressure bar 80 can rotate the cassette 10 from a first position to a second position at which it is retained relative to the cartridge receiving bay 120 and printing on the label material can take place without fear of the cassette 10 becoming dislodged from this retained position. The longitudinal axis of the pressure bar 80 is parallel to the axis defined by the connection portions 12, 14. Accordingly, the engagement portion 82 is on the second corner region 22 above the exit slot 24 for the label material.

As briefly mentioned above, this rotation of the cassette 10 relative to the receiving bay 120 as a result of movement of the pressure bar 80 results in relative movement between the cassette 10 and the brake actuating member 174 attached to the receiving bay 120 and located in the opening 27 of the cassette. Since the brake actuating member 174 is located under the brake member 34 of the cassette 10, this rotational movement of the cassette 10 from its first to its second position causes the brake actuating member 174 lift the brake member 34 relative to the rest of the cassette 10, thus releasing the pressure of the braking member 34 on the label material 8. In the cassette's first position the brake on the label material 8 is applied, and thus the label material 8 is clamped by the brake 26. In the cassette's second position, the brake on the label material 8 is not applied, and thus the label material 8 is removable from the cassette 10.

In other embodiments of the present invention, the opening 27 may be provided in a wall of the cassette receiving bay 120 and the brake member 34 may include a projection which cooperates with the edge of the opening, such that the brake member 34 is lifted to release the brake on the label material 8 as a result of the cassette moving from its first position to its second position.

In still further embodiments, a magnetic switch may be used to operate the brake.

Figure 4B:
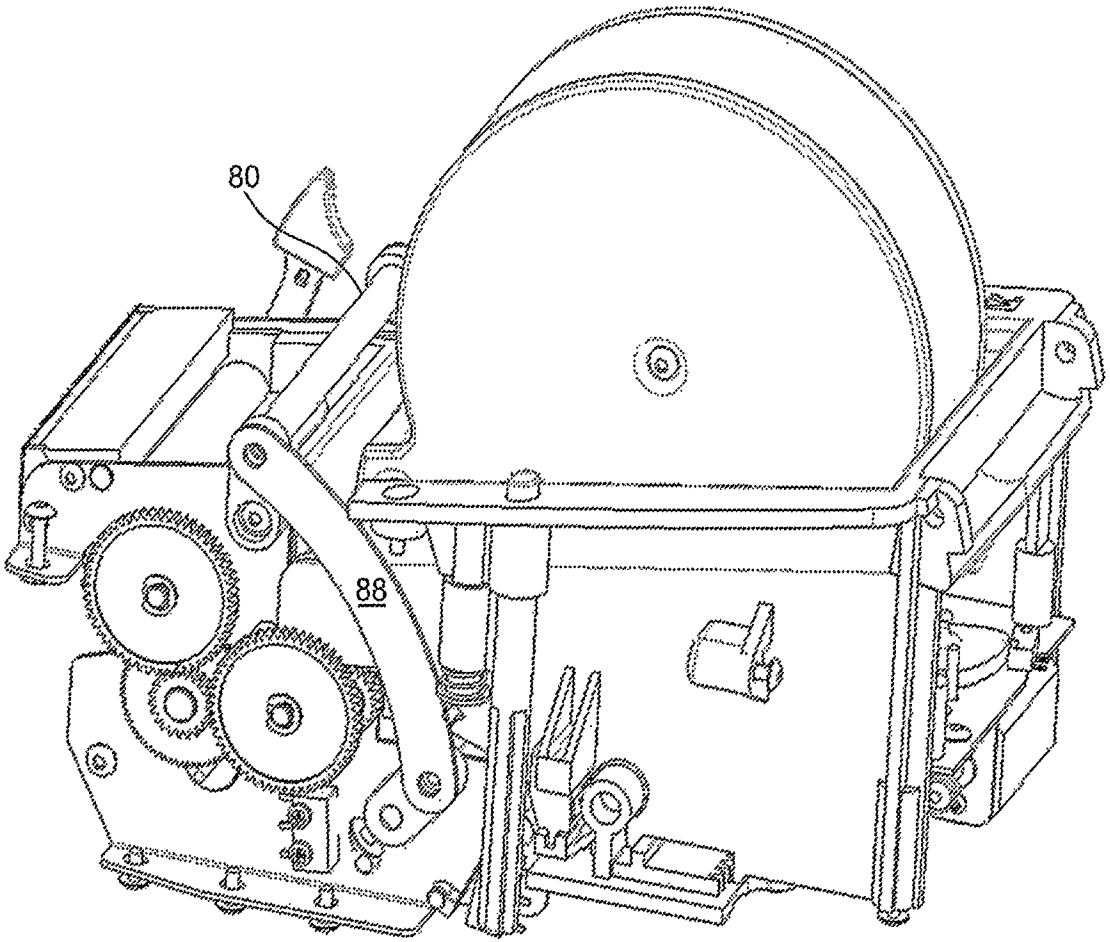
FIG. 4B shows a perspective view of part of the label printer, with the pressure bar mechanism in configuration of FIG. 4A and the cassette in place.
Figure 5A:
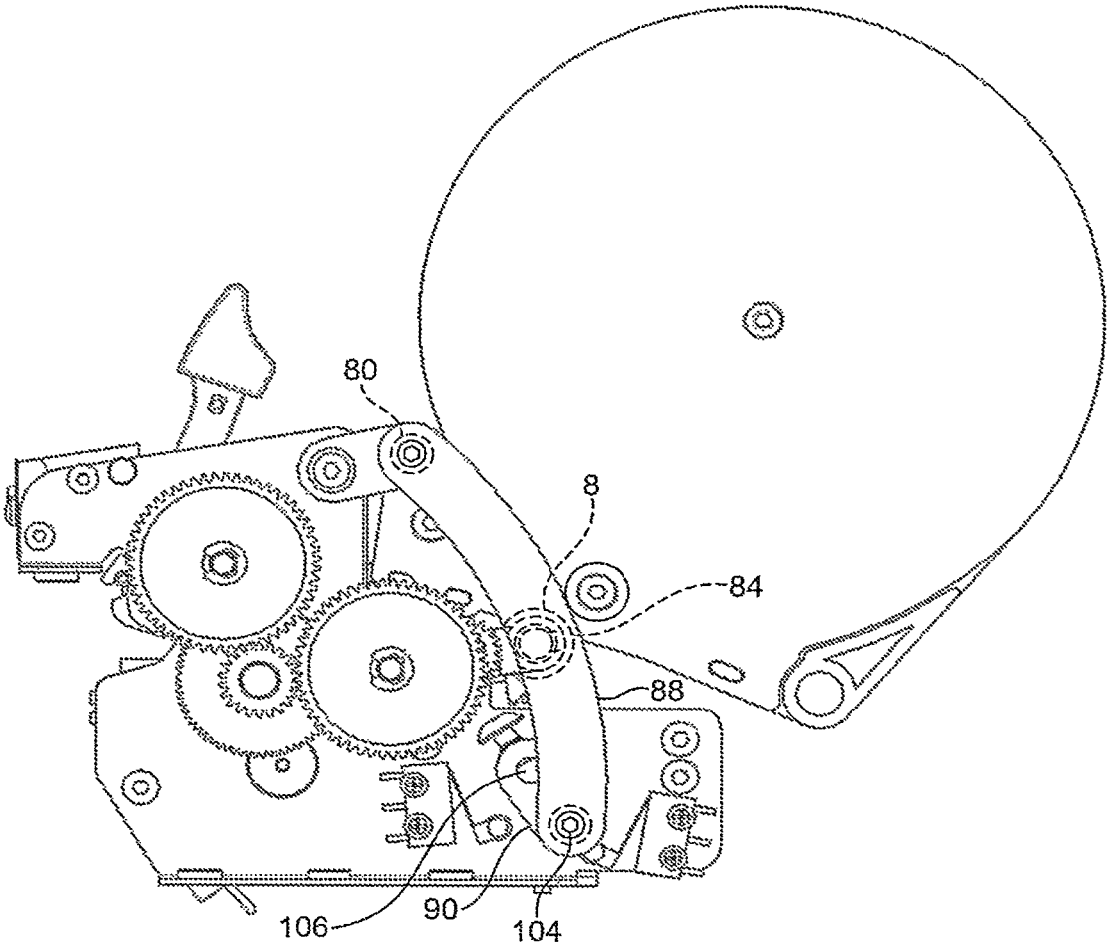
FIG. 5A shows a similar view to FIG. 4A but with the pressure bar mechanism engaging the cassette, and a feed roller in an engaged position.
Figure 5B:
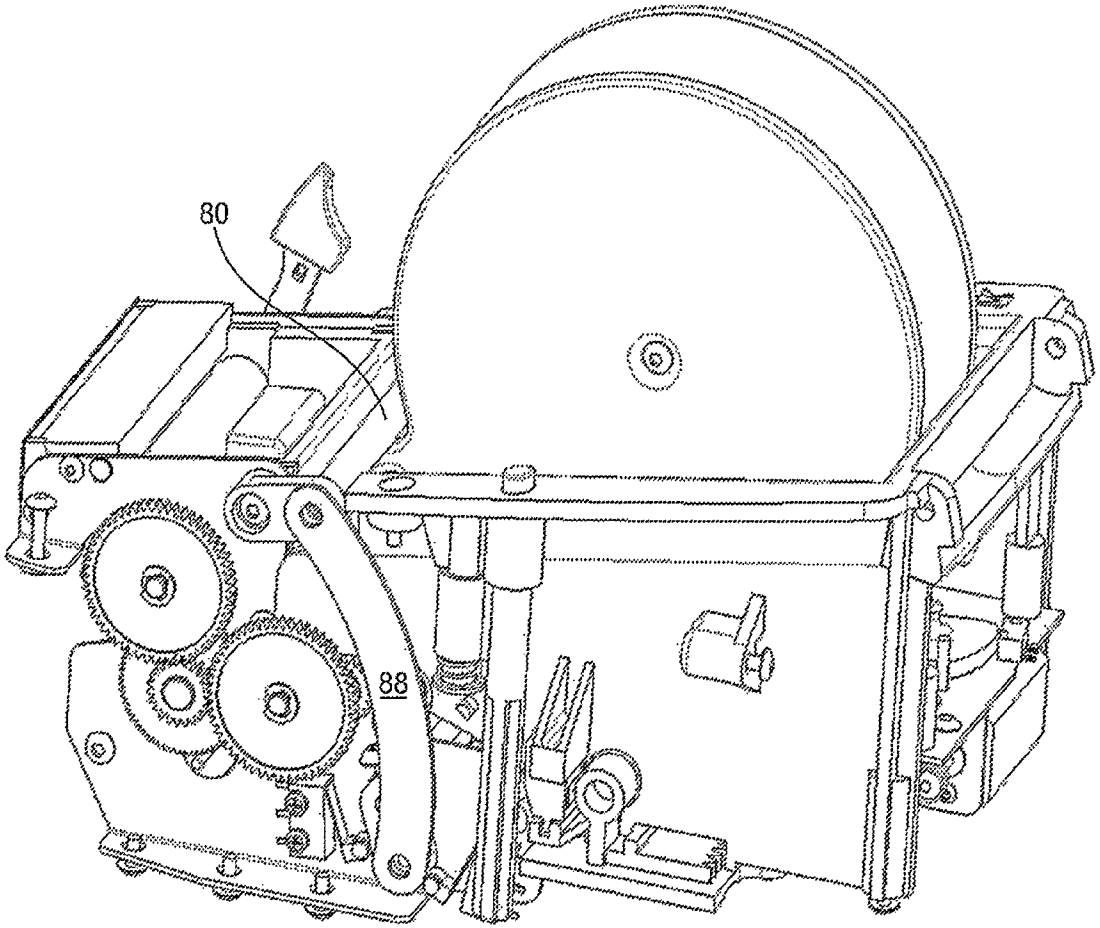
FIG. 5B shows a similar view to FIG. 4B, but with the pressure bar mechanism in an engaged configuration.

In some embodiments of the present invention, the movement of the pressure bar 80 from its first configuration (as shown in FIGS. 4A & 4B) to its second configuration (as shown in FIGS. 5A & 5B) is only possible once the cassette 10 has been left-justified in the receiving bay 120, as will be described in detail below. Similarly, in some embodiments of the present invention, movement of the cassette 10 between its first and second positions resulting from the movement of the pressure bar 80 is only possible once the cassette 10 has been left-justified in the receiving bay 120.

In some embodiments of the present invention, it is advantageous to have the pressure bar 80 acting on the region of the engagement portion 82 below the area of the cassette 10 which accommodates the roll of label material 8. This is because a more compact arrangement may be achieved in certain embodiments of the present invention. As mentioned previously, the cassette 10 is generally arranged vertically in preferred embodiments of the invention. By "vertically", it is meant that the axis of rotation 20 of the cassette 10 is horizontal and the sides 16, 18 of the cassette 10 are each located in a vertical plane. The label material 8 is coiled in a vertical plane perpendicular to the axis of rotation 20. So, when the label printing apparatus is in normal use, to insert a cassette 10 into the cassette receiving bay 120, a user lowers the cassette downwards vertically into the bay 120 with the axis of rotation of the cassette 10 aligned horizontally and the sides 16, 18 of the cassette 10 each lying, at least substantially, in a vertical plane.

The engagement portion 82 has a longitudinal axis parallel to an axis about which the supply of label material 8 in the cassette 10 is arranged to rotate.

The shape of the engagement portion 82 can have any suitable shape. However, the shape of the engagement portion 82 is such that the pressure bar 80 is encouraged to engage the cassette 10 and not to slide out of engagement therewith. In one embodiment the pressure bar 80 is a generally elongate member and the engagement portion 82 is provided by a recessed or a suitably shaped indented portion of the cassette 10.

In one embodiment of the invention, there are three stages associated with the movement of the pressure bar 80. In the first stage, the pressure bar 80 is spaced from the associated engagement portion 82 of the cassette. A feed roller 84 which can feed the label material 8 out of or into the cassette 10 is spaced from the label material 8 so that there is no engagement of the feed roller 84 with the label material 8. This is illustrated in FIGS. 4A and 4B. In this position, the cassette 10 can freely rotate about the axis defined by the indented portions 12 and 14, and thus is not retained in position relative to the cartridge receiving bay 120.

In a second stage, which is illustrated in FIGS. 5A and 5B, the pressure bar 80 is engaged with the engagement portion 82 of the cassette and has rotated the cassette 10 about the axis defined by the indented portions 12 and 14, to retain the cassette 10 in a position relative to the cartridge receiving bay 120. The feed roller 84 is engaged with the label material 8. It is at this second stage, i.e. when the pressure bar 80 is engaged with the cassette 10, that the pressure bar 80 can rotate the cassette 10 as discussed above, i.e. in a vertical plane. Note that in the embodiment shown in the attached drawings, the feed roller 84 does not move relative to the main body of the label printing apparatus as the pressure bar 80 moves from its first stage to its second stage. Instead, the pressure bar 80 and cassette 10 move relative to the feed roller 84. In other embodiments, the feed roller 84 moves relative to the main body of the label printing apparatus as the pressure bar 80 moves from its first stage to its second stage.

In the third stage, the pressure bar 80 is engaged with the engagement portion 82 of the cassette and the feed roller 84 is disengaged from the label material 8. It will be noted that in the embodiment shown in the drawings, the feed roller 84 has moved relative to the main body of the label printing apparatus as the pressure bar 80 goes from its second stage to its third stage.

As can be seen from a consideration of FIGS. 1A, 1B and 2B, the cassette 10 is shaped so as to have an opening 86 adjacent to the opening 27 for releasing the media brake 26. The sides 16 and 18 of the cassette are shaped to have a semi circular cross section adjacent the feed roller opening 86 to facilitate interaction with the feed roller 84. The feed roller 84 is arranged to engage the label material 8 and press it against the surface 32 of the guiding member 28. This is at a position on surface 32 of the guiding member 28 adjacent to the hole or gap 48 in the guiding member 28 through which the brake member 34 extends to engage the label material 8 against surface 30.

The feed roller 84 is provided for feeding the label material 8 out of the cassette. This may for example be provided in order to make sure that the print head is correctly aligned with a discrete or die cut labels in the longitudinal direction of the label material 8. Additionally or alternatively, the feed roller 84 is provided in order to feed the label material 8 back into the cassette 10.

The feed roller 84 is preferably biased upwards towards the receiving bay 120, to ensure that the feed roller 84 contacts the label material 8 with sufficient pressure to create friction between the feed roller 84 and the label material 8, to feed the label material 8. Such biasing could be provided by a spring. However, in some embodiments of the present invention, the feed roller 84 is not spring loaded. The feed roller 84 may be fixed in position relative to the receiving bay 120.

It should be appreciated that in some embodiments of the present invention, the feed roller 84 can be dispensed with and the function associated with the feed roller 84 can instead be provided by a platen. In that alternative embodiment, there would be a simple two stage movement associated with the pressure bar 80 and there would be relative movement between the print head of the label printing apparatus and the platen.

Figure 6:
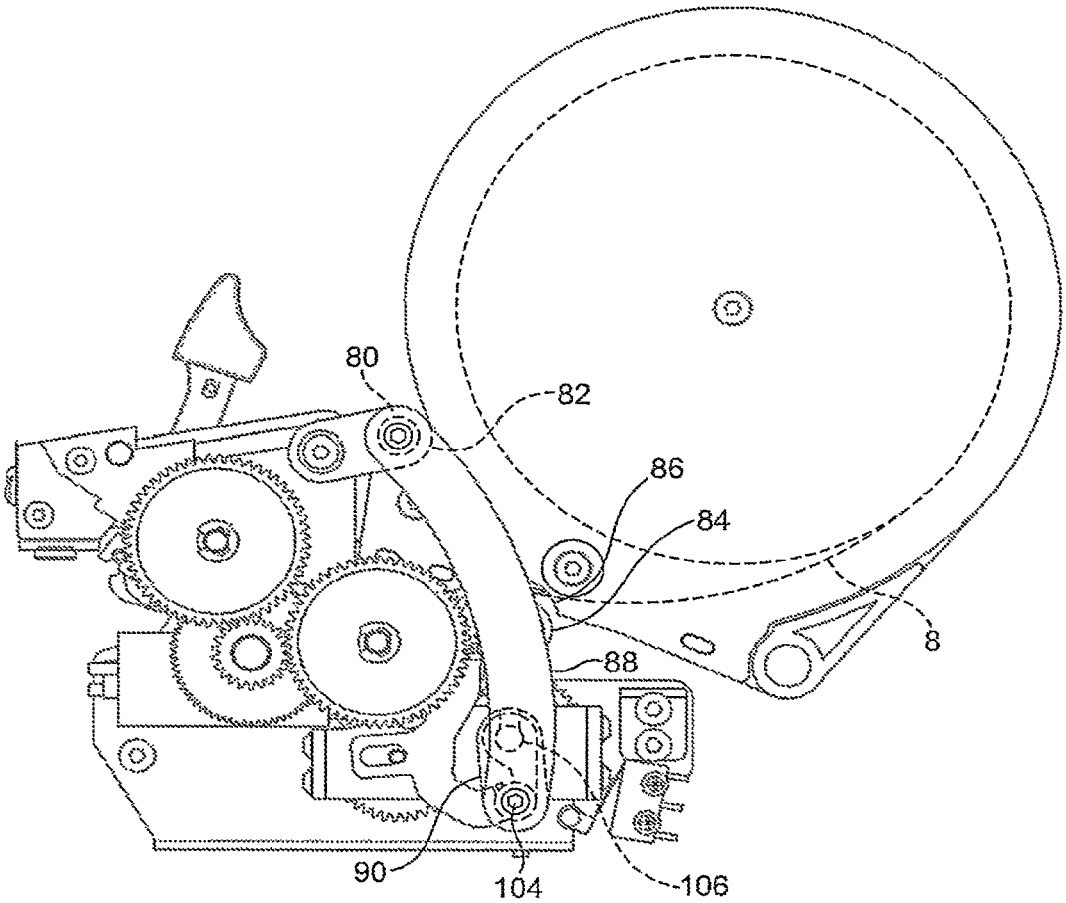
FIG. 6 shows a similar view to FIGS. 4A and 5A but with the pressure bar mechanism engaged and the feed roller disengaged.

As mentioned, there is a three stage movement associated with the pressure bar. The third stage, which is illustrated in FIG. 6, disengages the feed roller 84. This is to allow the removal of contact of the label material 8 with the feed roller 84 during printing. It may be that the print quality is compromised by having both the feed roller 84 and a platen roller engaged with label material 8 during printing. However, it should be appreciated that in some embodiments of the present invention, the third stage, as illustrated in FIG. 6, can be omitted and that printing can occur with the feed roller 84 in the position shown for example in FIG. 5.

The pressure bar 80 comprises an elongate bar with a circular cross section. The pressure bar 80 is connected at each end to a linkage member 88. The two linkage members 88 are generally curved, elongate members. The linkage members 88 are such that during the movement of the pressure bar 80 between the first and second stages, the linkage members 88 generally define an arc of a circle or similar shape.

Each linkage member 88 is connected to respective ends of a cam linkage member 90 at the opposite end of the respective linkage member 88 to the end connected to the pressure bar 80. Rotation of each cam linkage member 90 relative to each respective linkage member 88 is about axis 104. The cam-linkage members 90 are arranged to be connected to opposite ends of a cam shaft 92. The cam shaft 92 is connected to the each cam-linkage member 90 at a position spaced apart from the point at which each cam linkage member 90 is connected to the linkage member 88. Each cam linkage member 90 is arranged to rotate about an axis 106 defined by the cam shaft 92.

The extent of movement of the pressure bar 80, and hence the linkage members 88, is limited by physical stop features with associated detector switches.

The pressure bar is driven between its two positions by a motor 100 and associated gear train 102. The motor 100 and gear train 102 can be seen from FIG. 8. The motor moves the pressure bar 80 between the positions shown in the FIGS. 4, 5 and 6.

Figure 7:
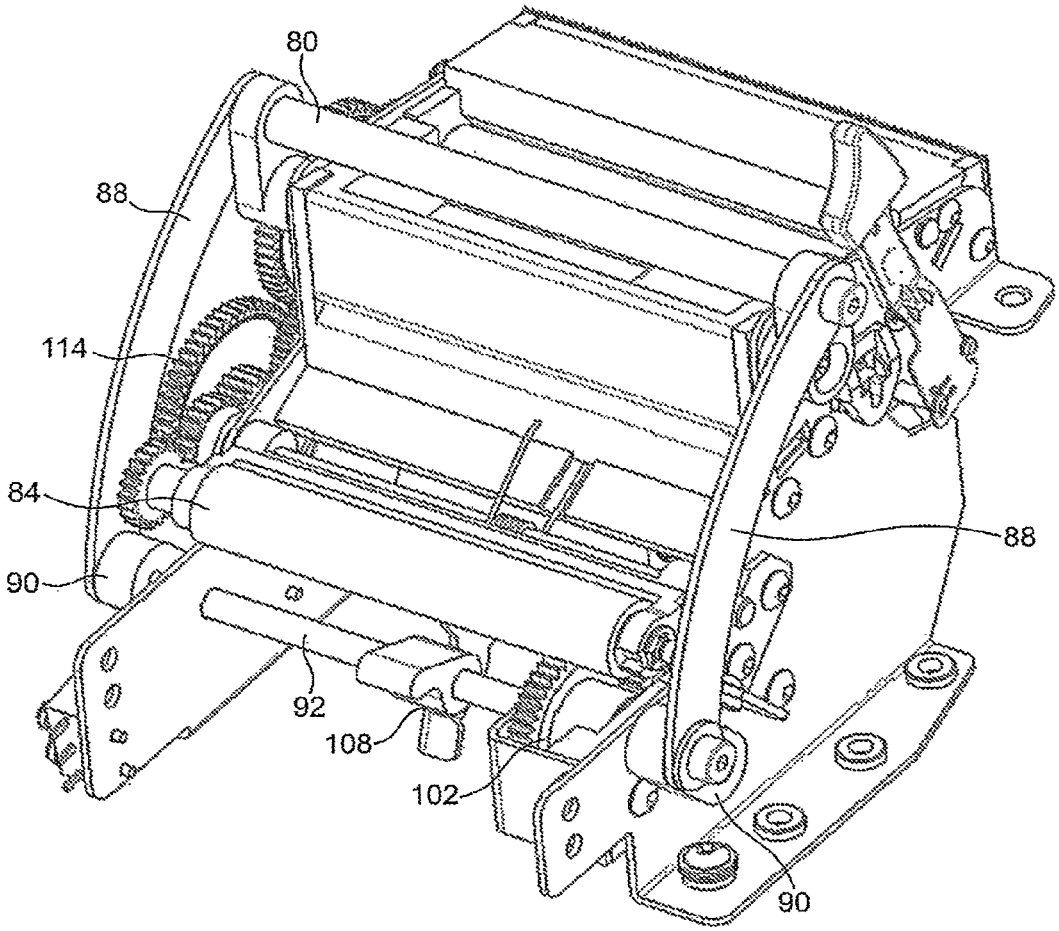
FIG. 7 shows a perspective view of the pressure bar mechanism.
Figure 8:
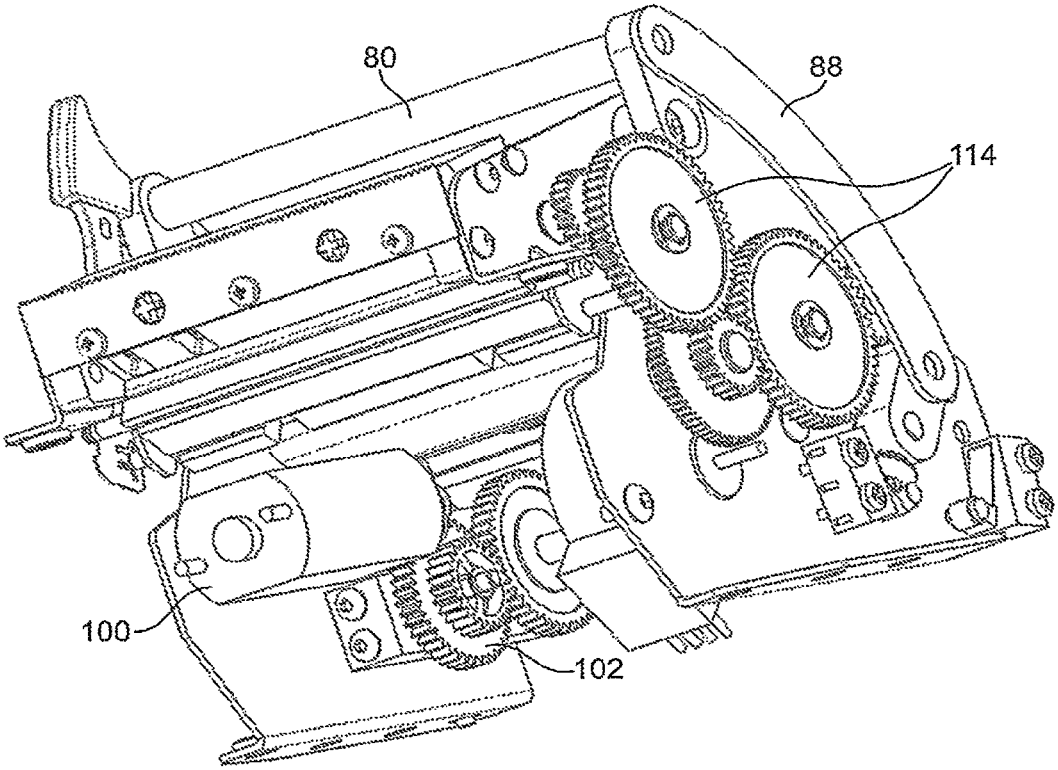
FIG. 8 shows a perspective view of the pressure bar mechanism, from an opposite side to that shown in FIG. 7.

The cam linkage mechanism 90 determines whether the feed roller 84 is in contact with the label material 8 or spaced there from. As can be seen from a comparison of FIGS. 5A and 6, the cam linkage member 90 moves between two positions, about an axis 106. The axis 106 is the axis of the cam shaft 92. When the cam linkage member 90 is in the position shown in FIG. 5A, a cam 108 mounted on the cam shaft 92 engages a support member of the floating feed roller 84. This urges the feed roller 84 into the position shown in FIG. 5A, that is engaged with the label material 8. Cam 108 is shown in FIG. 7.

In contrast, when the cam linkage member 90 is in a position shown in FIG. 6, the cam member 108 is disengaged from the floating feed roller support and accordingly, the feed roller adopts the position shown in FIG. 6, in which the feed roller 84 is spaced apart from the label material 8. The cam member 108 is engaged and disengaged from the floating feed roller support as a result of the cam linkage member 90 being moved from its position shown in FIG. 5*a* to its position shown in FIG. 6. This is caused by additional rotation of the pressure bar drive mechanism, which additional rotation marginally moves the pressure bar 80 itself, but in other embodiments may not move it at all.

A torsion spring is provided to counterbalance gravity, in order to make sure the cartridge 10 rotates up about the axis defined by the indented portions 12 and 14 when the pressure bar 80 disengages from the cartridge 10, aiding removal of the cartridge 10 from the receiving bay 120.

In one embodiment of the present invention, a feed roller gear train 114 is provided to drive the feed roller 84, when required. This feed roller gear train 114 can be seen from FIG. 8. This feed roller 84 will be driven by a print engine motor, not shown. In alternative embodiments of the present invention, this feed roller gear train 114 may be driven by the same motor used to drive the pressure bar mechanism.

With some embodiments of the present invention, a range of differently sized cassettes 10 can be accommodated in the cassette receiving bay 120. The cassette receiving bay 120 can be sized so as to receive the largest size of cassette 10 with a relatively small amount of play to ensure that the cassette 10 is correctly positioned by a positioning mechanism. The positioning mechanism will be described in more detail hereinafter. In other embodiments of the present invention, the cassette receiving bay 120 may be much larger than the size of the cassette 10 received in the cassette receiving bay 120.

In the embodiment illustrated in FIGS. 9 and 10, the cassette 10 is relatively small compared to the size of the cassette receiving bay 120.

The user places the cassette 10 in the cassette receiving bay 120. There is no requirement to place the cassette 10 into the correct position. Rather, the user merely has to place the cassette 10 in the correct orientation into the cassette receiving bay 120 and the positioning mechanism, which will be described in more detail hereinafter, will move the cassette 10 into the correct configuration.

Figure 9A:
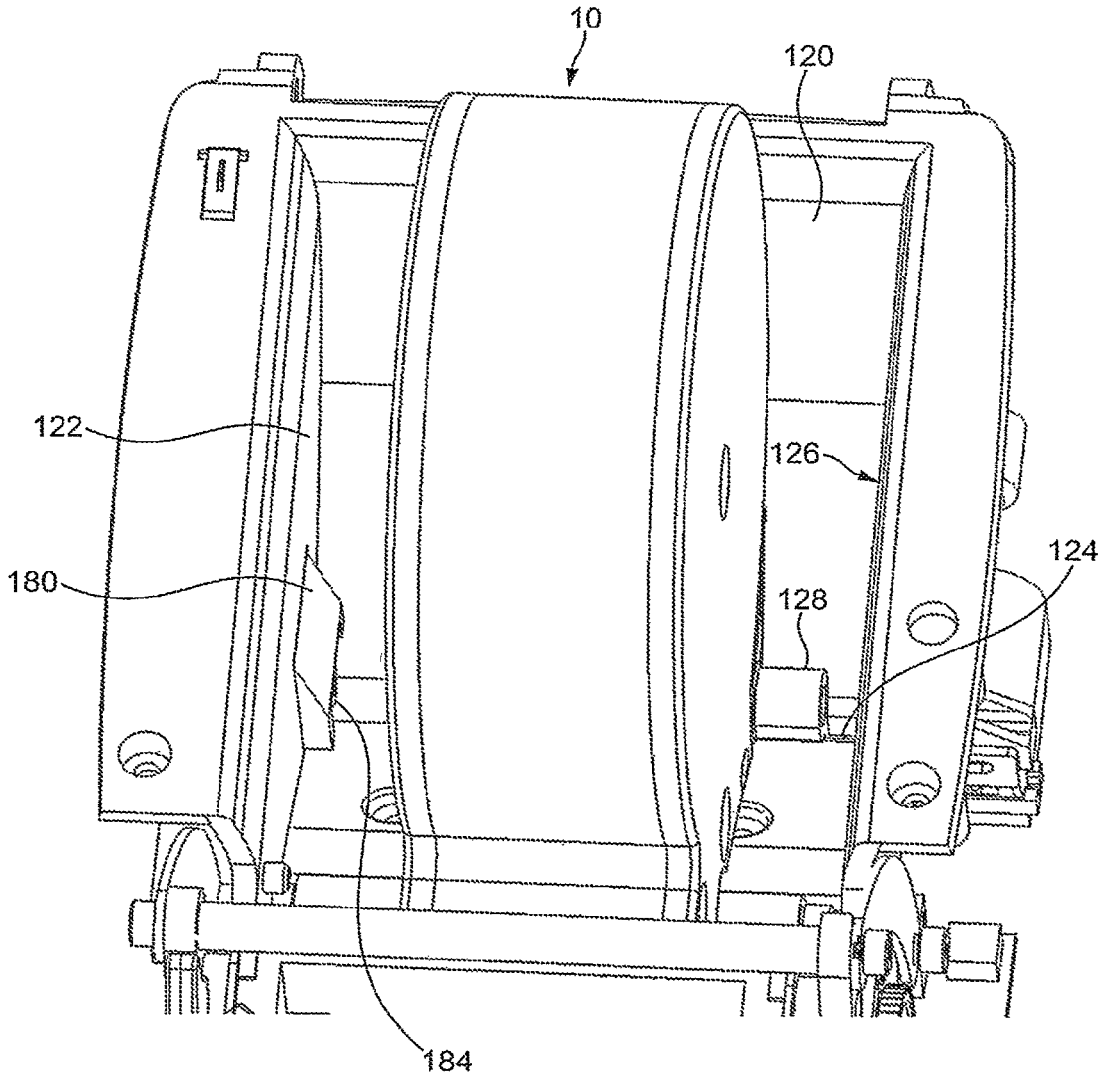
FIG. 9A shows a cassette inserted in the cassette receiving bay, in a first position.
Figure 9B:
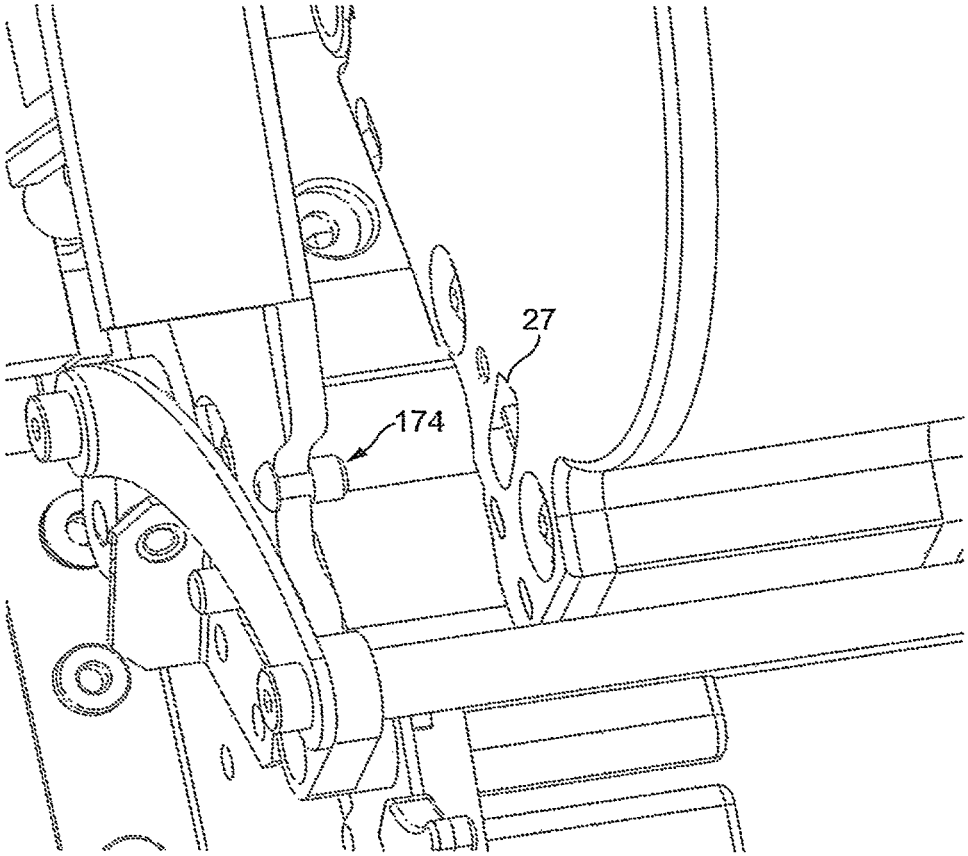
FIG. 9B shows in detail the release mechanism for the media brake of the cassette, when the cassette is in the cassette receiving bay as shown in FIG. 9A.

The user inserts the cassette 10 into the receiving bay 120 in a direction that lies in a vertical plane. Thus, when the cassette is inserted, the sides 16, 18 of the cassette 10 lie in a vertical plane and the axis of rotation 20 of the cassette and label material 8 is horizontal. The sides 16, 18 of the cassette 10 may each lie in a vertical plane in the receiving bay 120 at any distance in the bay 120 from the sides 122, 126 of the receiving bay 120. In this regard, FIGS. 9A and 9B show the scenario where the cassette 10 has been placed in the cassette receiving bay 120 by the user. In the arrangement shown in FIGS. 9A and 9B, the cassette 10 is not in the correct position for printing.

Figure 10A:
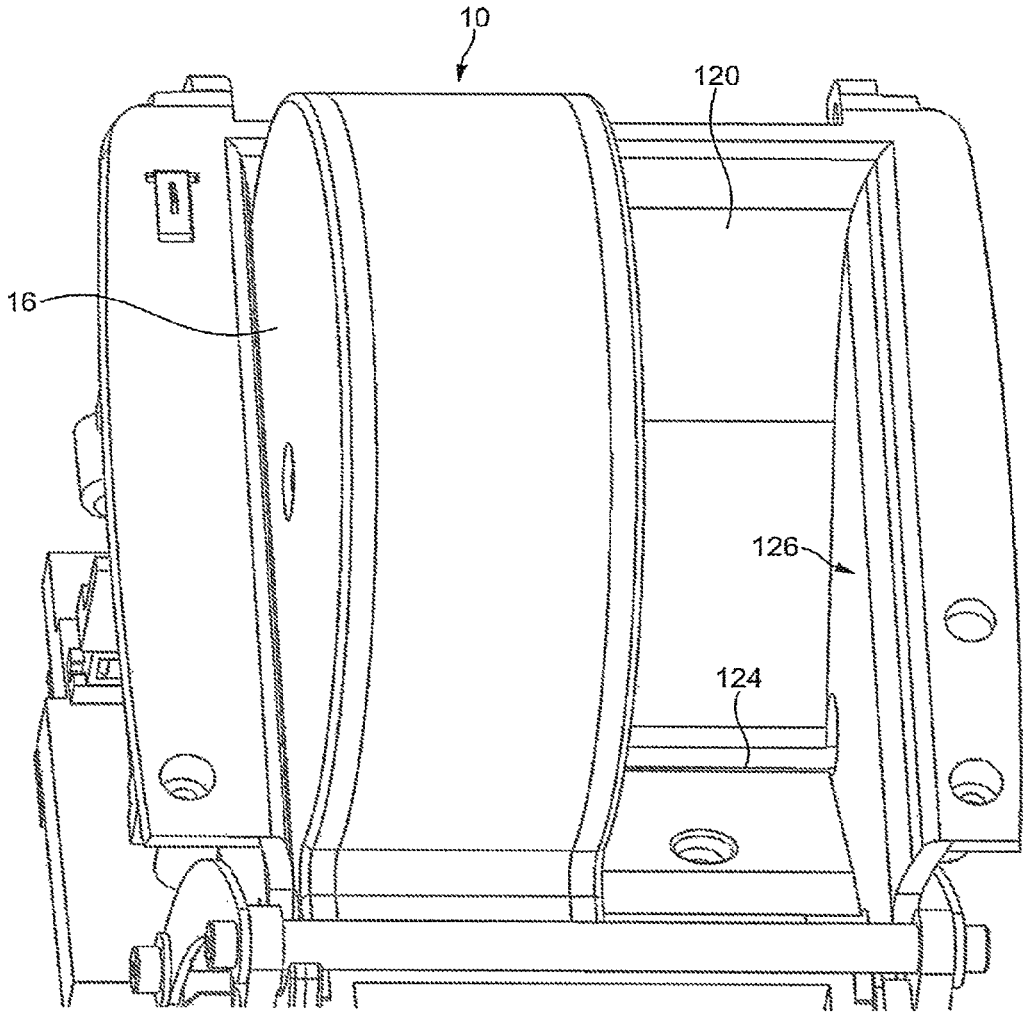
FIG. 10A shows the cassette in a second position in the cassette receiving bay, this being the position in which printing can take place.

The positioning mechanism causes the cassette 10 to be moved to the orientation shown in FIG. 10A. This orientation is such that the cassette 10 is pushed against one side wall 122 of the cassette receiving bay 120. Side wall 122 effectively engages side 16 of the cassette 10. At this position, printing can take place. This is termed "left-justifying" the cassette 10.

In other embodiments, the cassette 10 may instead be "right-justified", i.e. pushed towards the opposite side wall 126 of the receiving bay 120 such that side wall 126 engages side 18 of the cassette 10. The position in which printing can take place would then be when the side wall 126 engages side 18 of the cassette 10.

In other embodiments, the cassette may be positioned by the positioning mechanism at a point somewhere between side walls 122, 126 at which printing can take place, i.e. with neither side 16 nor side 18 of the cassette 10 engaging a side wall 122, 126 of the bay 120. The cassette 10 may be positioned at a position equidistant between the side walls 122, 126 of the bay 120.

In other embodiments, there may be a plurality of positions at which printing can take place, and the positioning mechanism may cause the cassette 10 to be located at any one of these plural positions.

The positioning mechanism will now be described with reference to FIGS. 9 to 13. The positioning mechanism is a left-justifying mechanism. At the bottom of the cassette receiving bay 120 is a guide slot 124. The guide slot 124 extends perpendicularly with respect to the first side wall 122 and a second side wall 126, which is opposite to the first side wall 122. A pushing member 128 is arranged in the bottom of the cassette receiving bay 120. Part of the pushing member 128 is above the floor of the cassette receiving bay 120 and part below. The pushing member 128 extends through the guide slot 124. The movement of the pushing member 128 is guided by the slot 124. Accordingly, the pushing member 128 will extend through the slot 124. The pushing member 128 preferably has an end part in the cassette receiving bay which is larger than the width of the slot. This is to ensure that the pusher member 128 is correctly positioned with respect to the cassette receiving bay 120 and does not move below the floor of the cassette receiving bay 120.

Figure 11B:
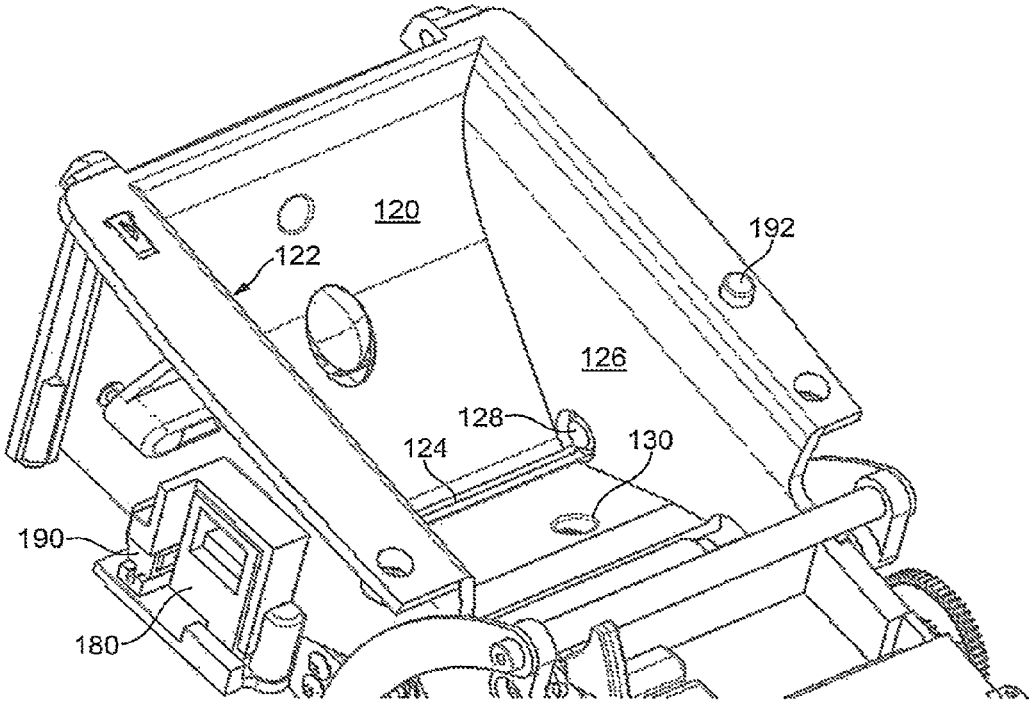
FIG. 11B shows a second view of the cassette receiving bay, from a second direction so that a second, opposite side wall is visible.

As can be seen from FIG. 11B, the pushing member 128 has a first position where it is provided adjacent the second side wall 126, opposite the first side wall 122. This allows the cassette 10 to be freely inserted into the cassette receiving bay 120 without interference from the pushing member 128.

In some embodiments of the present invention, a sensor 130 is provided. This sensor 130 is arranged to detect the insertion of a cassette 10. This sensor 130 may take any suitable format and may for example be a pressure sensor. In alternative embodiments of the present invention, the sensor 130 can for example be an optical sensor or the like. In other embodiments, the sensor 130 may detect a tag on a cassette 10, such as an RFID (Radio-frequency identification) tag or other electronic tag.

In some embodiments, a second sensor 192 is also provided to detect when a lid (not shown) over the receiving bay 120 is closed. The lid may be lockable. The lid prevents a user from touching a cassette 10 located in the receiving bay 120 and prevents foreign objects falling into the cassette receiving bay 120 which may interrupt the operation of the cassette positioning mechanism. Again, this second sensor 192 may be a pressure sensor, an optical sensor, or any other kind of suitable sensor. Either or both of the sensor 130 and second sensor 192 may be omitted.

In the embodiment shown in the figures, when the sensor 130 detects the presence of a cassette, the pushing member 128 moves from the position adjacent wall 126, along the slot 124 and towards the wall 122. The pushing member 128 will engage with indented portion 14 of the cassette. In embodiments which include the second sensor 192, such movement of the pushing member may be prevented until the second sensor 192 detects that the lid is closed.

An engagement member 184 is provided on the first side wall 122 which engages with first indented portion 12. The engagement member 184 and the pushing member 128 are shaped to be received at a respective end thereof in the respective indented portion 12, 14 of the cassette 10. To prevent the engagement member 184 from interfering with the insertion of the cassette 10 a protection member 180 is provided. This protection member 180 is in the form of a ramp sloping away from the first side wall 122 of the bay 120 in a direction away from the mouth of the cassette receiving bay 120, the mouth being the open end of the bay 120 through which a cassette is inserted into the bay 120. The protection member 180 defines a recess in which the engagement member 184 is accommodated adjacent side wall 122. The mechanism for moving the protection member will be described later. In the alternative the protection member 180 may be omitted and a similar function may be provided by a recess in the side wall 122.

Figure 12:
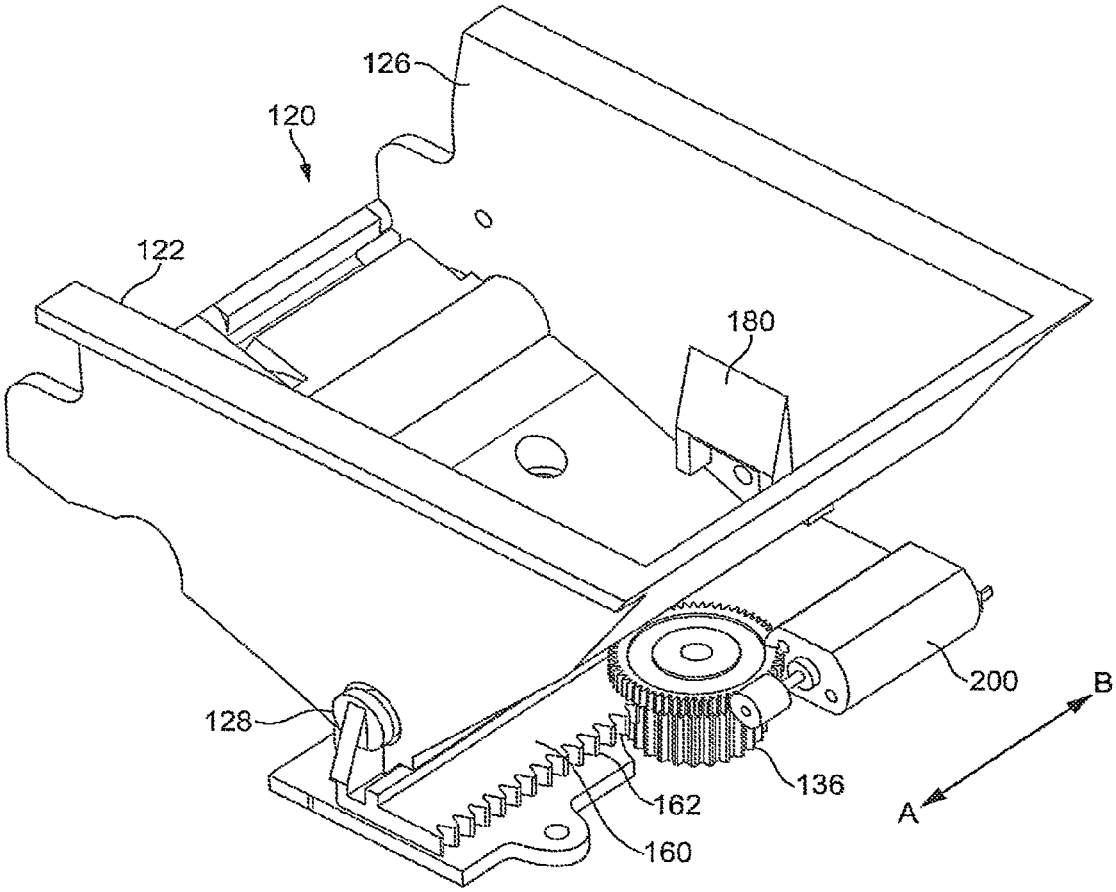
FIG. 12 shows a perspective view of the cassette receiving bay in combination with the cassette moving mechanism.
Figure 13:
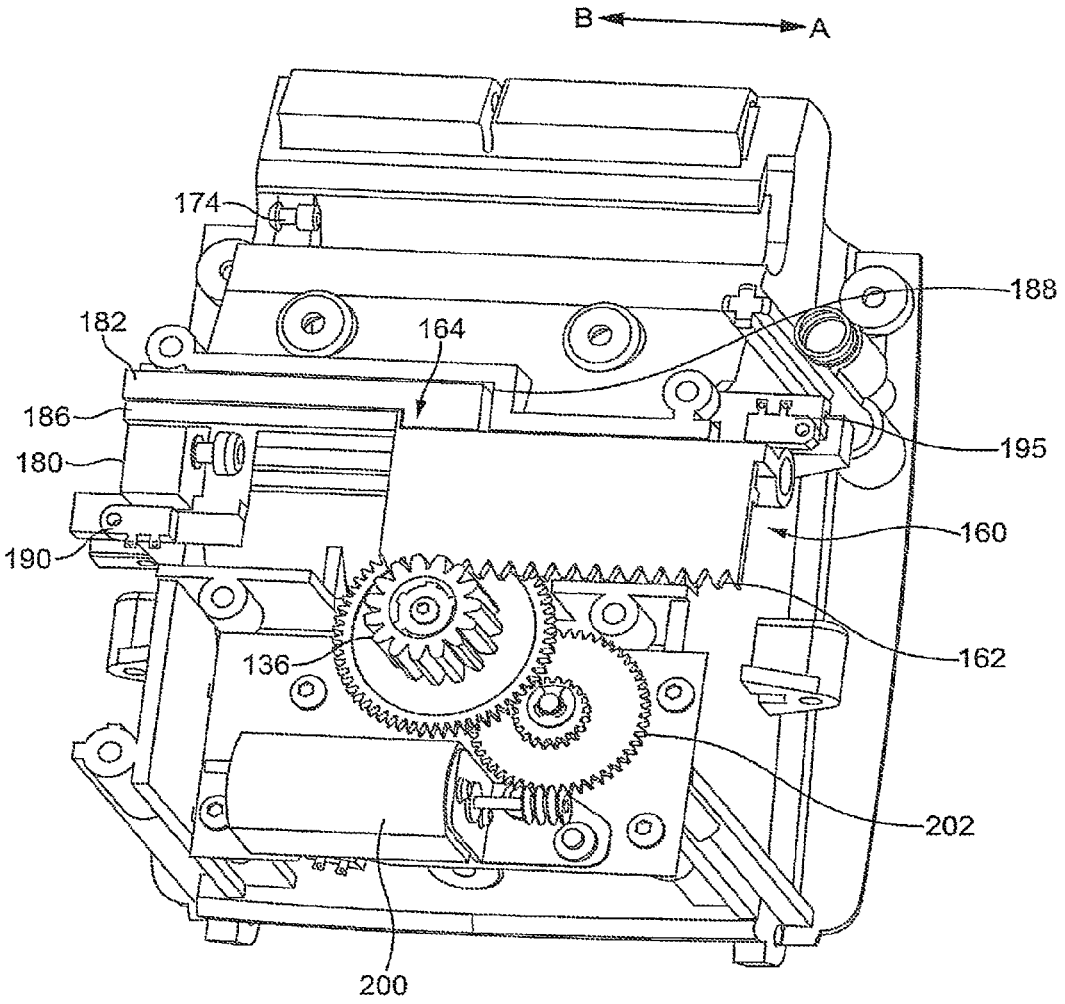
FIG. 13 shows the cassette moving mechanism, as seen below the cassette receiving bay.

The mechanism for moving the pushing member 128 can be seen clearly from FIGS. 12 and 13. FIG. 12 shows a slightly different arrangement of the motor 200 relative to the gear 136 when compared to the arrangement shown in FIG. 13, but the principle of operation is the same. The pushing member 128 is supported on a plate member 160, located below the floor of the cassette receiving bay 120. FIG. 13 shows clearly the element positioned below the cassette receiving bay 120. The plate member 160 is generally rectangular and along one edge thereof is provided a plurality of teeth 162. These teeth 162 are arranged to engage with a gear 136, which is driven by a motor 200 via a gear-train 202. Rotation of the gear 136 causes the plate support member 160 to be moved either in the direction of Arrow A or in the direction of Arrow B, as indicated at the top of FIG. 13. This movement is parallel to the guiding slot 124. After a cassette 10 has been inserted, the plate member 160 will move in the direction of Arrow B so that the pushing member 128 supported by the plate member 160 is moved towards the first side wall 122. It should be appreciated that the pushing member 128 will be connected to the plate member 160 through the guide slot 124.

Thus, when it is determined by the sensor 130 that a cassette has been inserted in the cassette receiving bay, the pushing member 128 is moved through the cooperation between the gear 136 and the teeth 162. The gear 136 turns anticlockwise, as FIG. 13 is drawn. The pusher member 128 is moved towards wall 122 and will engage with the cassette 10. In one preferred embodiment of the present invention, the pusher member 128 is shaped so as to engage the indented portion 14. This is opposite to the indented portion 12 (see FIG. 1A) of the cassette. Such movement of plate member 160 triggers sensor 195 to lock the lid over the cassette receiving bay 120. Sensor 195 may take any suitable format and may for example be a pressure sensor. In alternative embodiments of the present invention, the sensor 195 can for example be an optical sensor or the like. In some embodiments, the sensor 195 may be omitted, or the lid can be locked by other means. Where no lid is provided, the sensor 195 may be omitted.

When the cassette 10 has travelled part way towards the first side wall 122 it contacts the protection member 180. The cassette 10 is further moved towards the first side wall 122 and in doing so moves the protection member 180 in the same direction as the direction of travel of the cassette 10 to expose the engagement member 184 which engages the first indented portion 12. Movement of the protection member 180 in this way causes the protection member 180 to trip a sensor 190 located externally to the receiving bay 120 when the cassette 10 has reached the first side wall 122 and, thus, when the protection member 180 has been fully moved to expose the engagement member 184. Sensor 190 may be of the same type, or a different type, to sensor 195.

As described previously, the media brake 26 is used to retain the label material 8 in position when the cassette 10 is transported. Movement of the cassette 10 towards the first side wall 122, as just described, results in relative movement between the cassette 10 and the brake actuating member 174 which protrudes from the first side wall 122. When the cassette 10 reaches the first side wall 122, the brake actuating member 174 is located in the opening 27 in the cassette 10, as discussed above. The pressure bar 80 discussed above then moves from its first stage to its second stage (as shown in FIGS. 5A and 5B), and is permitted to rotate the cassette 10 about the axis defined by the pushing member 128 and engagement member 184 from the first position of the cassette to the second position, thus causing the brake actuating member 174 to move brake member 34 away from the label material 8 in the cassette 10, allowing the label material 8 to be drawn from the cassette 10 through the outlet 24.

In this embodiment, such movement of the pressure bar 80 is only permitted when the sensor 190 has detected that the protection member 180 has been fully moved to expose the engagement member 184 and thus that the cassette 10 is in a position at which printing can take place. In other embodiments, the sensor 190 can be omitted and the determination as to when or whether the pressure bar 80 is permitted to move can be accomplished in other ways. As can be seen from FIG. 13, protection member 180 is mounted on a support plate 182. This plate has a smooth track 186 running along its length which extends in the direction of motion of the protection member 180. The track 186 terminates at one end of the support plate 182 with a stop 188. In other words, the track 186 only extends part way along the support plate 182. The stop 188 is provided at the end of the support plate 182 furthest from the protection member 180. Plate member 160, to which the pushing member 128 is connected through the guide slot 124, includes a projection 164 projecting outwards from the opposite side of plate member 160 to that which includes teeth 162. The projection 164 sits in the track 186 of support plate 182.

When a user wishes to remove a cassette 10 from the cassette receiving bay 120, the gear 136 is driven in the opposite direction to that described above, i.e. clockwise, causing the plate member 160 to move in the direction of arrow A to go back to its initial position and to cause the brake actuating member 174 to be removed from the opening 27 in the cassette 10.

As the plate member 160 moves, the projection 164 on plate member 160 travels along the track 186 of support plate 182. The projection 164 contacts the stop 188 of the support plate 182 and draws the support plate 182 in the direction of arrow A. As will be readily understood, this movement of the support plate 182 moves the protection member 180 in the direction of arrow A away from first side wall 122. Since the cassette 10 in the cassette receiving bay 120 is abutting the protection member 180, the cassette 10 is also drawn in the direction of arrow A by the protection member 180. This movement of the protection member 180 results in the engagement member 184 being enveloped by the protection member 180 again.

Once the plate member 160 nears or reaches its position of furthest travel in the direction of arrow A, it triggers sensor 195. Triggering of this sensor 195 may disengage the lock (not shown) which held the lid over the cassette receiving bay 120, thereby allowing the user to open the lid and remove the cassette 10. In other embodiments, such as where a lid is not provided, sensor 195 may be omitted.

It should be appreciated that in alternative embodiments of the invention, the media brake may be released by a similar mechanism which is independent of the positioning mechanism, and/or independent of the movement of the pressure bar 80.

It should also be appreciated that each of the mechanisms discussed herein may be provided in a cassette or a label printing apparatus, as appropriate, independently or in combination with another or others of the mechanisms discussed herein.

The foregoing merely illustrates the principles of the invention. Various modifications and alterations to the described embodiments will be apparent to those skilled in the art in view of the teachings herein. It will thus be appreciated that those skilled in the art will be able to devise numerous techniques which, although not explicitly described herein, embody the principles of the invention and are thus within the spirit and scope of the invention.

What is claimed is:

1. A cassette comprising:

a base, a top, and at least one side extending between said base and said top;

a support post fixed to said base;

an outlet;

a supply of label material having a central opening comprising a core; and an element in communication with said support post and in said core of said central opening, said element and said support post being arranged to resist relative rotation of said element and said support post in a drive direction unless at least a predetermined force is applied, wherein the drive direction is arranged such that the label material is caused to exit said cassette through said outlet.

2. A cassette as claimed in claim 1, wherein one of the outer circumference of the support post and the interior of said element is circular.

3. A cassette as claimed in claim 1, wherein one of the outer circumference of the support post and the interior of said element is a polygon.

4. A cassette as claimed in claim 3, wherein said polygon is a hexagon.

5. A cassette as claimed in claim 1, wherein said element is operable to receive said predetermined force exerted by a driven roller of a label printing apparatus in which said cassette is accommodated.

6. A cassette as claimed in claim 1, wherein said element is configured to be flexible.

7. A cassette as claimed in claim 6, wherein said element is provided with a plurality of cut out portions whereby said element is flexible.

8. A cassette as claimed in claim 7, wherein the outer circumference of the support post is a polygon; and the internal diameter of the element at the distal end of prongs between the plurality of cut out portions is less than the diameter of the polygon circumference of the support post when the latter is measured between two opposing peaks of the polygon circumference.

9. A cassette as claimed in claim 1, wherein said element and an interior surface of said opening are arranged to resist relative rotation of said element and said opening unless a second predetermined force is applied, the second predetermined force being greater than said predetermined force.

10. A cassette as claimed in claim 9, wherein one or more projections are provided on one or other of the element and the interior surface of the opening, said projections creating an interference fit between the element and the interior surface of the opening.

11. A cassette as claimed in claim 1, wherein said element comprises an insert.

12. A cassette as claimed in claim 1, wherein said element comprises a friction providing element.

13. A cassette as claimed in claim 1, wherein said element comprises a resistance providing element.

14. A cassette as claimed in claim 1, wherein said element flexibly resists relative rotation of said element and said support post unless said predetermined force is applied.

15. A cassette comprising:

a base, a top, and at least one side extending between said base and said top;

support means fixed to said base;

an outlet;

a supply of label material having a central opening comprising a core; and element means in communication with said support means and in said core of said central opening, said element means and said support means being arranged to resist relative rotation of said element means and said support means in a drive direction unless at least a predetermined force is applied, wherein the drive direction is arranged such that the label material is caused to exit said cassette through said outlet.

16. In combination, a label printing apparatus and a cassette accommodated in said label printing apparatus, said cassette comprising:

a base, a top, and at least one side extending between said base and said top;

a support post fixed to said base;

an outlet;

a supply of label material having a central opening comprising a core; and an element in communication with said support post and in said core of said central opening, said element and said support post being arranged to resist relative rotation of said element and said support post in a drive direction unless at least a predetermined force is applied;

wherein the drive direction is arranged such that the label material is caused to exit said cassette through said outlet, and wherein said predetermined force is applied to said label material by a driven roller of the label printing apparatus in which said cassette is accommodated.

* * * * *